US010982571B2

(12) United States Patent
Niethammer

(10) Patent No.: US 10,982,571 B2
(45) Date of Patent: Apr. 20, 2021

(54) DEVICE FOR ADJUSTING THE STROKE OF A VALVE OF INTERNAL COMBUSTION ENGINES

(71) Applicant: Bernd Niethammer, Koenigsfeld (DE)

(72) Inventor: Bernd Niethammer, Koenigsfeld (DE)

( * ) Notice: Subject to any disclaimer, the term of this patent is extended or adjusted under 35 U.S.C. 154(b) by 0 days.

(21) Appl. No.: 16/615,421

(22) PCT Filed: May 22, 2018

(86) PCT No.: PCT/EP2018/000271

§ 371 (c)(1),
(2) Date: Nov. 21, 2019

(87) PCT Pub. No.: WO2018/215093

PCT Pub. Date: Nov. 29, 2018

(65) Prior Publication Data

US 2020/0347753 A1 Nov. 5, 2020

(30) Foreign Application Priority Data

May 22, 2017 (DE) ..... 10 2017 005 069.4

(51) Int. Cl.
*F01L 1/34* (2006.01)
*F01L 1/08* (2006.01)
(Continued)

(52) U.S. Cl.
CPC ..... *F01L 1/08* (2013.01); *F01L 1/143* (2013.01); *F01L 9/14* (2021.01);
(Continued)

(58) Field of Classification Search
CPC ..... F01L 1/08; F01L 1/143; F01L 2800/10; F01L 2001/34446; F01L 2305/00; F01L 9/025
See application file for complete search history.

(56) References Cited

U.S. PATENT DOCUMENTS 4,716,863 A 6/1988 Pruzan
4,982,706 A 1/1991 Rembold
(Continued)

FOREIGN PATENT DOCUMENTS

CN 103016597 4/2013
DE 10231214 1/2004
(Continued)

OTHER PUBLICATIONS

International Search Report in related International Application No. PCT/EP2018/000271 dated Nov. 29, 2018, 7 pages.
(Continued)

*Primary Examiner* — Zelalem Eshete
(74) *Attorney, Agent, or Firm* — Andrew M. Calderon; Roberts Calderon Safran & Cole, P.C.

(57) ABSTRACT

The disclosure relates 10 a device which is used to adjust the valve stroke of internal combustion engines and has an actuation element for the valve stem. The actuation element is actuated by the camshaft and has a receiving space for a pressure medium. The receiving space is fluidically connected to a reservoir space of an adjustment reservoir. The volume of the reservoir space can be adjusted by means of a reservoir piston. The reservoir piston is loaded toward the reservoir space with a force that is greater than the force applied by the pressure medium and that is less than the restoring force acting on the piston.

19 Claims, 19 Drawing Sheets

(51) Int. Cl.

| | |
|---|---|
| ***F01L 1/14*** | (2006.01) |
| *F01L 1/344* | (2006.01) |
| *F01L 9/14* | (2021.01) |

(52) U.S. Cl.
CPC . *F01L 2001/34446* (2013.01); *F01L 2305/00* (2020.05); *F01L 2800/10* (2013.01)

(56) References Cited

U.S. PATENT DOCUMENTS

| | | | | |
|---|---|---|---|---|
| 5,113,812 | A * | 5/1992 | Rembold | F01L 9/025 123/90.12 |
| 2004/0000276 | A1 * | 1/2004 | Borean | F01L 9/02 123/90.12 |
| 2010/0326384 | A1 | 12/2010 | Vattaneo | |
| 2011/0277712 | A1 | 11/2011 | Haas et al. | |

FOREIGN PATENT DOCUMENTS

| | | |
|---|---|---|
| DE | 102006053703 | 6/2008 |
| WO | 2010034643 | 4/2010 |
| WO | 2015035856 | 3/2015 |

OTHER PUBLICATIONS

Written Opinion in related International Application No. PCT/EP2018/000271 dated Nov. 29, 2018, 5 pages.

* cited by examiner

DEVICE FOR ADJUSTING THE STROKE OF A VALVE OF INTERNAL COMBUSTION ENGINES

FIELD OF THE INVENTION

The invention relates to a device for adjusting the stroke of a valve of internal combustion engines according to the generic term of claim 1.

BACKGROUND

It is known to change the stroke of inlet and outlet valves of an internal combustion engine of motor vehicles in order to adjust the valve stroke or the valve opening time or both together. This valve stroke adjustment is carried out depending on the respective requirements for the internal combustion engine. For example, at high speeds of the engine, it is expedient to close the inlet valve as late as possible in order to obtain a good cylinder filling. Conversely, it makes sense for high torque at low engine speeds to close the inlet valve as early as possible.

For adjusting the valve stroke, camshaft controls are known, in which the relative angular position of the camshaft can be changed compared to the crankshaft. Such camshaft adjusters, however, are constructively elaborately desined.

For adjusting the valve stroke, it is further known to insert a pressure medium into the area between a valve tappet and a piston of the valve, so that a relative shift of the piston occurs against the valve tappet. For this purpose, a passage opening is provided in the wall of the valve tappet, which is connected to a pressure medium source when the tappet push through the camshaft is moved. The pressure agent flows into the area between the tappet and the piston, which shifts the piston relative to the tappet. If the valve tappet is moved back towards its initial position, the piston displaces the pressure medium to the pressure medium accumulator. With this device, a stepless adjustment of the valve stroke is not or only difficult to ensure.

SUMMARY

The invention is based on the object to train the generic device in such a way that the valve stroke can be easily adjusted in a constructively simple manner.

This object is solved in the generic device according to the invention with the characterizing features of claim 1.

In the device according to the invention, the valve is connected to the adjustment accumulator. In it there is a storage space, the volume of which can be changed depending on the desired valve stroke. The storage space is limited by a storage piston, which is loaded in the direction of the storage space by means of a force. This force is greater than the force exerted by the pressure medium on the storage piston, which is generated, for example, by the supply pressure of an oil lubrication pump. If the actuating element is adjusted by the camshaft, then the pressure medium can be partially displaced into the storage space of the adjustment accumulator. Since the volume of the storage space is adjustable, it can be determined how much of the pressure medium is displaced from the receiving chamber of the valve into the storage space. If the volume of the storage space of the adjustment accumulator is zero, then no pressure medium can be displaced from the accumulator storage, so that the valve performs its maximum stroke. However, as soon as the storage space has a certain volume, a corresponding proportion of the pressure medium can be displaced from the receiving chamber of the valve into the storage space. This has the consequence that at first only the actuating element is adjusted by the camshaft, while the piston carrying the valve shaft initially stops. Only when the storage space is filled by the displaced pressure medium, the camshaft simultaneously removes the actuating element and the Piston moved. These results in a lower stroke distance of the valve compared to a storage space whose volume is zero. The volume of the storage space in the adjustment accumulator can be advantageously infinitely adjusted, so that accordingly also the valve stroke can be infinitely adjusted. Since the resetting force acting on the piston of the valve is greater than the force acting on the storage piston, it is ensured that the piston of the valve is only moved by the camshaft when the corresponding proportion of pressure medium from the receiving chamber is valve has been displaced into the storage space of the adjustment accumulator.

In an advantageously very simple design, the force acting on the storage piston is generated by at least one reset spring. It loads the storage piston in such a way that, unless the actuating element of the valve is actuated, it is moved to an initial position. Since this force acting on the storage piston is greater than the force exerted by the pressure medium, the storage piston remains in its initial position due to the force acting on it. Only when the actuating element is adjusted by the camshaft, the pressure of the pressure medium is increased so much that the storage piston is shifted against the force acting on it, provided that the volume of the storage space is set to greater zero. Another advantage is that the energy stored in the accumulator is returned to the combustion motor via the camshaft. As a result, the system is virtually lossless.

A cost-effective and compact design results when the storage piston is formed as a hollow piston.

A simple adjustment of the volume of the storage space results when the adjustment distance of the storage piston is adjustable by at least one adjustment element. It can be adjusted relative to the storage piston so that it can only be adjusted from the output position a certain way through the pressure medium. Depending on the position of the adjustment element relative to the storage piston, the size of the storage space can be easily adjusted.

The accumulator element can be motorized or hydraulically be adjusted. In a motorized adjustment, the adjusting element can, for example, sit on a threaded spindle, which is driven by means of a motorized drive rotatably. Depending on the direction of rotation of the threaded spindle, the adjustment element is then axially adjusted in the respective direction. Here, the adjustment element is secured against rotation around its axis in a known manner, so that it performs only one displacement movement when turning the threaded spindle.

In a hydraulic drive, for example, the adjusting element sits on a piston, which is applied by means of a pressure medium to move it and thus the adjustment element. The piston can be loaded on one side with pressure medium and on the other side by a spring. In principle, a piston can be applied on both sides. Linear drives of various types are also conceivable.

In an advantageous embodiment, the adjustment element protrudes into the storage piston. Then the end face of the adjustment element forms a stop surface for the storage piston. Depending on the position of the end face of the adjusting element, it is determined how far the storage piston from its initial position can be adjusted by the pressure medium displaced from the receiving chamber of the valve.

Advantageously, a dampening device can be placed between the adjusting element and the storage piston to build a damping chamber, which is at least partially filled with the pressure medium. The damping chamber prevents a strong impacting, flattening and a bouncing of the storage piston.

Advantageous here is, if in the damping chamber additionally a damping spring is provided.

In order to compensate for leakage losses in the use of the adjustment storage, the storage piston is provided with at least one supply line for leakage medium. In this supply line sits a check valve, which opens in the direction of the damping chamber. This makes it possible to insert pressure media into the damping chamber via the supply line and the check valve to compensate for leakage losses. The opening pressure of this check valve is less than the pressure of the pressure medium.

The receiving chamber of the valve is connected to a pump in a preferred embodiment via at least one line, with which the pressure medium can be introduced into the receiving chamber. In this line sits a valve closing against the pump, so that the pressure medium can only flow from the pump via the line towards the receiving chamber. This valve is advantageously a check valve. It is provided that it also locks the storage space of the adjustment accumulator opposite the pump.

In a simple embodiment, each inlet valve and outlet valve can be connected to an adjustment accumulator. In such a case, it is possible to adjust the valve stroke of each valve independently of each other. Then engine valve overlaps are also possible.

However, it is advantageous to connect several valves to the adjustment accumulator. In this case, however, the valves connected to the adjustment accumulator can only be operated in time at a time; Valve overlaps are not possible.

In such a case, it is advantageous if in the line connection from the adjustment accumulator to the valves connected to it, a shut-off valve sits. With the shut-off valves, the line connection between the valve to be operated and the adjustment accumulator can be reliably established.

Only the shut-off valve whose valve is to be operated is opened. The other shut-off valves remain closed.

If valve overlaps are to be possible without letting the structural effort of the device become too large, it is provided in a preferred embodiment that the device has at least two adjustment accumulators, to which two or more valves will be connected. Then a valve of one adjustment accumulator and a valve of the other adjustment accumulator can be operated in such a way that valve overlaps occur.

The subject-matter of the application arises not only from the subject-matter of the individual claims, but also from all the information and features disclosed in the drawings and description. They are claimed, even if they are not subject-matter of the claims, as essential inventive, insofar as they are new individually or in combination with the prior art.

BRIEF DESCRIPTION OF THE DRAWINGS

Further features of the invention result from the further indications, the description and the drawings.

The invention is explained in more detail on the basis of some embodiments presented in the drawings. Showing it FIG. 1 in schematic representation a device according to the invention for adjusting the valve stroke, FIG. 2 in enlarged representation a part of the device according to the invention, FIG. 2*a* in a representation according to FIG. 2 a further embodiment of a device according to the invention, FIG. 2*b* the stroke curve of the device according to FIG. 2*a*, FIG. 3 up to 5 different positions of a storage piston of the inventive device, FIG. 5*a* a further embodiment of an adjustment accumulator of the installation device, FIGS. 6 and 6*a* further embodiments of an adjustment accumulator of the installation device, FIG. 7 up to 9 the schematics of further embodiments of devices of the invention, FIG. 10 a further embodiment of a device according to the invention, FIG. 11 a variant of a throttle valve of the device according to FIG. 10, FIG. 12 up to 15 each further embodiments of devices according to the invention.

DETAILED DESCRIPTION OF THE INVENTION

The facilities according to the FIGS. 1 to 9 are intended to adjust the stroke of valves 1 to 4 of internal combustion engines. These valves are inlet and outlet valves in combustion chambers of the internal combustion engines of vehicles. The valves 1 to 4 are operated by means of camshafts 5 in a known manner A camshaft is provided for the inlet and outlet valves. In the following, we generally speak of valves without distinguishing between inlet and outlet valves.

Figure 1:
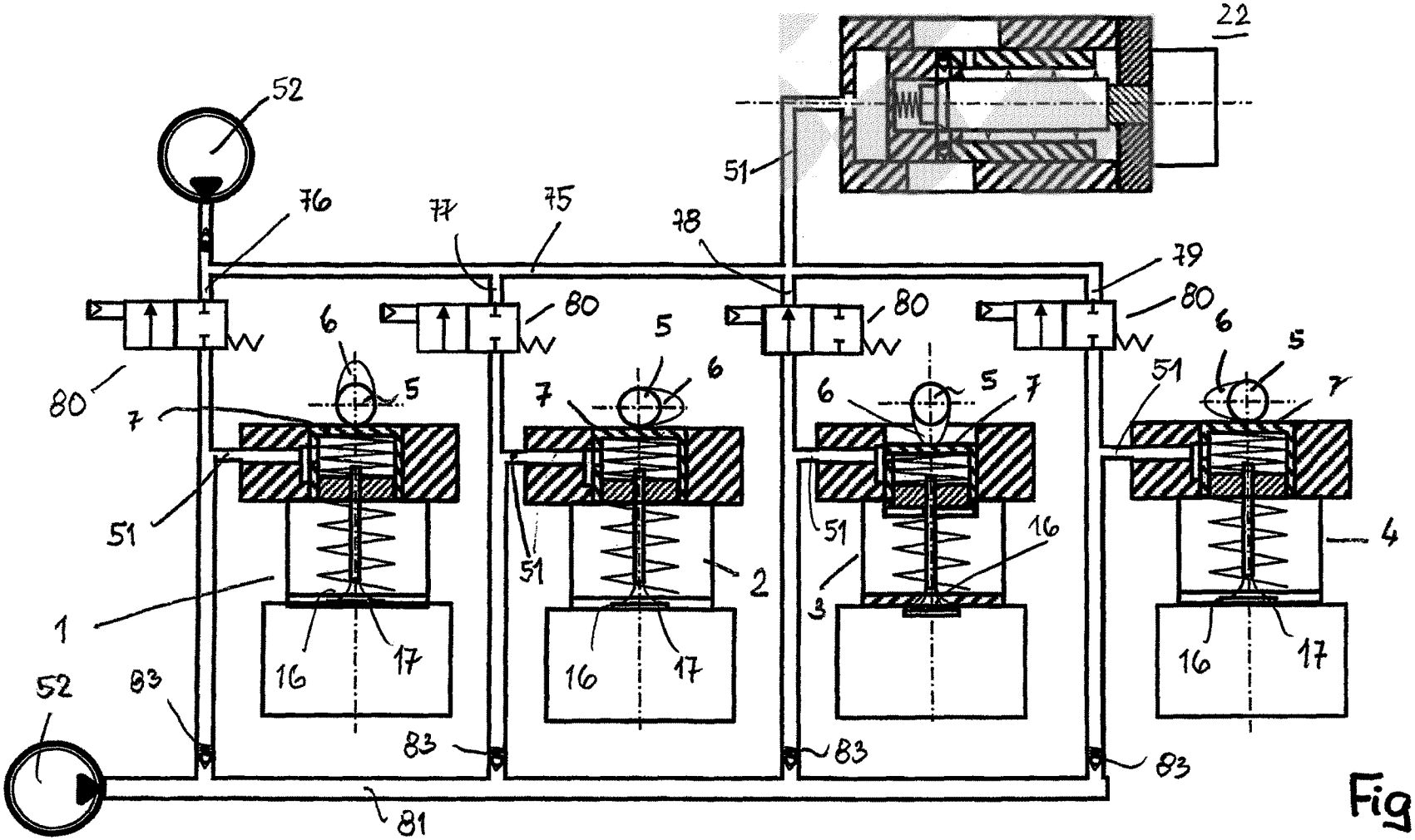

In FIG. 1 examples are shown four valves 1 to 4, which interact with the camshaft 5. It has camshaft 6, which is acting with a tappet 7 of the valves 1 to 4.

In FIG. 1 are shown as examples four different positions of the camshaft 5. In valves 1, 2 and 4, the cam 6 takes such a position that the valve tappet 7 is not adjusted. In the valve 3, the camshaft 5 is rotated so that the corresponding cam 6 has moved the tappet 7 to its maximum position downwards, so that the valve 3 is open.

The camshaft 5 has in a known manner shows over its length several cams 6, which have different angular positions in relation to the camshaft 5. When turning the camshaft 5 around its axis, the corresponding valves of the internal combustion engine are actuated with the cams 6 on it.

Figure 2:
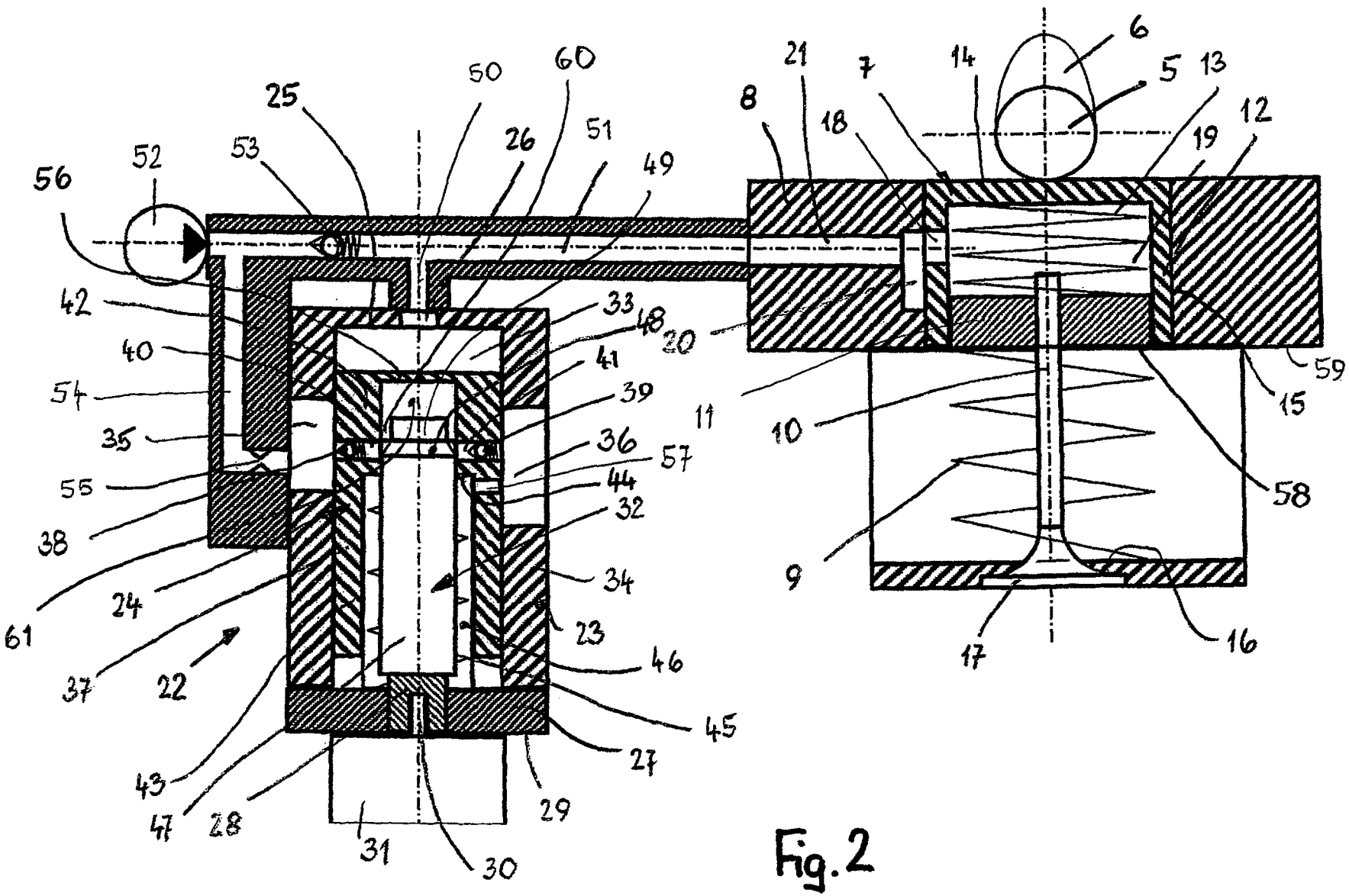

FIG. 2 shows example of one of the valves 1 to 4. It has the tappet 7, which is movable in a cylinder head 8 of the combustion engine against the force of at least one spring 9. The valve spring 9 is in the embodiment a coil pressure spring, which surrounds a valve shaft 10 with distance. It is fastened with one end in a piston 11, which is movable in the valve tappet 7. The piston 11 is attached to the inner wall of a cylindrical coat 12 of the valve tappet 7. Within the valve tappet 7 is accommodated at least one tappet push spring 13, which supports itself with its one end at the piston disc 11 and with its other end on a bottom 14 of the valve tappet 7. Through the bottom 14 the valve tappet 7 is closed against the camshaft7. Advantageously, the ground 14 single-piece formed with the mantle 12, which with its edge facing the camshaft 5 passes into the flat ground 14.

The valve tappet 7 is mounted in a bore 15 of the cylinder head 8 movable.

FIG. 2 shows the tappet bump 7 in its initial position, in which a valve plate 17 closes an inlet/outlet opening 16 of a combustion chamber.

If the camshaft 5 is turned, the cam 6 assigned to the valve tappet 7 comes into contact with the bottom 14 of the valve tappet 7 and shifts it against the force of the tappet push spring 13 in the direction of the open position. The valve plate 17 provided at the free end of the valve shaft 10 releases the inlet/outlet opening 16, so that in the case of an inlet valve, the medium (air, oxygen, fuel, fuel mixture) enters the combustion chamber and, in the case of an outlet valve, the exhaust gases from the combustion chamber. The valve spring 9 ensures that the tappet 7 is pushed back to its initial position as soon as the cam 6 no longer exerts lifting force on the valve tappet 7.

The coat (liner) 12 of the valve tappet 7 is provided with an opening 18, by which the enclosed by the coat 12 enclosed reception room 19 is connected to a feeding room 20. It is located in the inner wall of the cylinder head 8. The feeding room 20 is in the lifting direction of the valve tappet 7 so long that in each lifting position of the valve tappet 7 the opening 18 is connected with the feeding room 20 flow-connected. Preferably, the feeding room 20 is formed as a ring channel, so that the tappet 7 can rotate.

A hole 21 in the cylinder head 8 flows into the feeding room 20. Through it, the valve is connected to an adjustment accumulator 22, with which the stroke of the valve can be adjusted.

The adjustment accumulator 22 has a housing 23, in which a formed as a hollow piston storage piston 24 sealed can be moved. The housing 23 can also be part of the engine or the vehicle, for example, the cylinder head. Such training enables a cost-effective variant.

The housing 23 is closed on one end side by a ceiling 25, in which there is a passage opening 26. It is advantageously provided centrically in the ceiling 25. At the opposite end side, the housing 23 is closed by a cover disc 27.

In the cover plate 27, a threaded spindle 28 with its one end rotatable is mounted. It is arranged in such a way that it does not protrude over the underside 29 of the cover disc 27. The threaded spindle 28 is provided at its free end with a connection 30 for an adjustment motor 31, which is in FIG. 2 is shown only schematically. The adjusting motor 31 can be any suitable motor, such as an electric motor or a linear motor. With it, the threaded spindle 28 can be driven rotatably around its axis.

On the threaded spindle 28 sits a sleeve-shaped adjustment element 32, which protrudes over most of its length into the storage piston 24 and is rotationally connected to it. The rotational connection can be achieved, for example, by an uncircular or angular outline shape of the adjusting element 32.

The storage piston 24 is closed towards the ceiling 25 of the housing 23 and is open in the direction of the cover plate 27. Between the storage piston 24 and the ceiling 25 of the housing 23 is formed a storage space 33, whose volume changes depending on the relative position of the storage piston 24 compared to the housing 23.

In the preferably cylindrical coat 34 of the housing 23 are diametrically opposed to each other two breaks 35, 36 provided. They extend in the moving direction of the storage piston 24, in whose preferably cylindrical liner 37 diametrically opposite to each other a check valve 38, 39 is provided. Both check valves 38, 39 are each in radial holes 40, 41, which enforce the cylindrical liner 37 of the storage piston 24. Advantageously, the radial holes 40, 41 in a thickened area 42 of the cylindrical liner 37 of the storage piston 24. The thickened coat area 42 extends from the end of the storage piston 24 facing the housing ceiling 25. The radial holes 40, 41 and the check valves 38, 39 arranged in them are at the level of breakthroughs 35, 36, which are in the adjustment direction of the storage piston 24 so long that the radial holes 40, 41 with the check valves 38, 39 in each axial position of the storage piston have 24 line connection to the breakthroughs 35, 36.

If the two check valves 38, 39, as shown in the embodiment shown, are at the same height, the storage piston 24 is secured against rotation around its axis, so that the line connection to the breakthroughs 35, 36 is guaranteed at all times.

The check valves 38, 39 or the radial holes 40, 41 can also be provided at different heights. Then the storage piston 24 can rotate in operation around its axis, if the breaks 35, 36 are connected via a ring channel in the accumulator 22.

The check valve 38 locks in the direction of breakout 35, while the diametrically opposite check valve opens 39 in the direction of breakout 36.

The check valves 38, 39 can be omitted if it is ensured that the storage space 33 does not run empty. This can be achieved by example in that the adjustment accumulator 22 is completely in the pressure medium, preferably oil.

At the transition from the thicker coat area 42 to a subsequent, reduced in the wall thickness area 43 of the cylindrical liner 37 of the storage piston 24, an annular shoulder surface 44 is formed, at which the one end of a compression spring 45 is attached. It surrounds the adjustment element 32 and lies in a ring space 46, which is formed between the coat area 43 and the adjustment element 32. The ring space 46 is open in the direction of the cover disc 27. In order for the adjustment element 32 within the storage piston 24 to be reliably axially moved, the compression spring 45 surrounds the adjusting element 32 with a distance. In addition, the compression spring has 45 distance from the inner wall of the storage piston 24.

The adjustment element 32 has a cylindrical section 47, which extends over most of the length of the adjustment element 32. At the end facing away from the cover disc 27, a cone section 48 connects to the cylindrical section 47, which is continuously tapered towards a cylindrical end section 49. It has a smaller outer diameter than the cylindrical section 47.

To the passage opening 26 in the housing ceiling 25 connects a transverse line 50, which flows into a line 51, which is connected to the bore 21 of the cylinder head 8 conduction. The line 51 is connected to a pump 52, with which engine oil can be conveyed under pressure into the line 51. In the direction of conveying in front of the transverse line 50, a check valve 53 opening in the direction of the bore 21 sits in the direction of the bore.

The breakthrough 35 in the housing 23 is connected to the line 51 via a connecting line 54. In the connecting line 54, which flows in the area between the pump 52 and the check valve 53 into the line 51, there is an aperture 55, which is advantageously arranged immediately before the breakthrough 35.

With the adjustment accumulator 22 it is possible to change the stroke of the valve. This is explained in more detail below.

In an output position, the storage piston 24 with its bottom 56 is attached to the housing ceiling 25, so that the volume of the storage space 33 is zero. The storage piston 24 is shifted by the compression spring 45, which supports the cover disc 27, into this stop position. The force F1 of the compression spring 45 is greater than the force exerted by the pressurized pressure medium on the storage piston 24.

In the receiving room 19 of the valve is also the pressure medium conveyed by the pump 52. It is preferably oil, the pressure of which is, for example, about 2 to 3 bar. As long as the valve tappet 7 is not actuated by the camshaft 5, the storage piston 24 remains in the described stop position, since the spring force F1 exerted on it is greater than the force exerted by the pressure medium.

If the tappet is shifted down through the cam 6, the pressure medium located in the receiving room 19 is displaced via the bore 21 and the line 51 to the adjustment accumulator 22, if the storage space 33 has a corresponding volume.

The storage space 33 is only released when the pressure medium is pumped into the storage space 33 via the valve tappet 7. The release of the accumulator space 33 is determined by the position of the adjusting element 32.

The larger the storage space 33, the more pressure medium can be displaced from the recording room 19 to the storage space 33.

Figure 5:
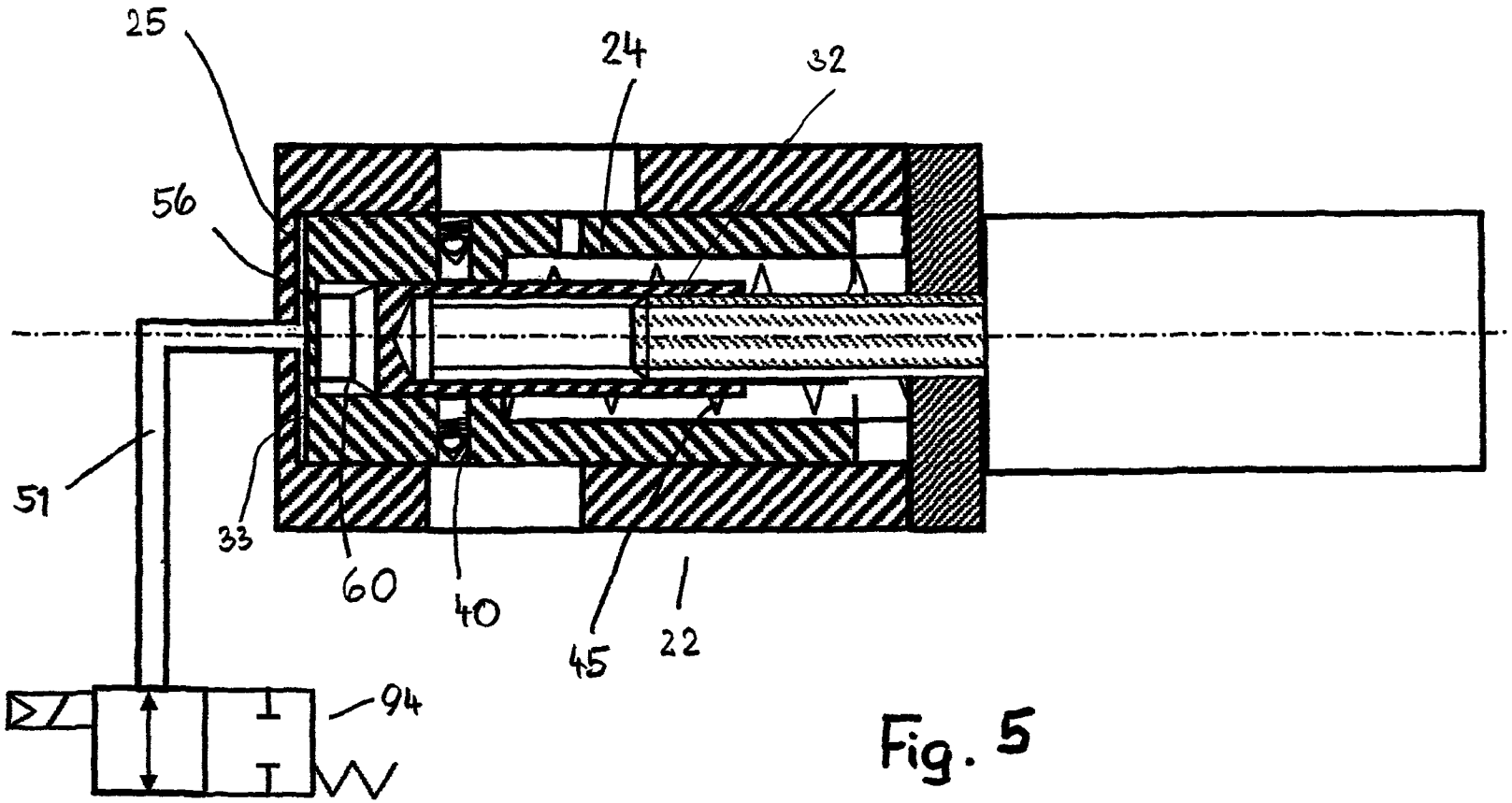

The size of the storage space 33 depends on the position of the adjustment element 32. It can be adjusted to such an extent that it is located with the end part of its end section 49 on the bottom 56 of the storage piston 25 attached to the housing ceiling 25 (FIG. 5). As a result, the storage piston 24 cannot be pushed back by the pressure medium. The pressure medium located in the receiving room 19 of the valve cannot therefore be displaced. The tappet 7 of the respective valve then performs its normal mechanically predetermined maximum stroke when the corresponding cam 6 of the camshaft 5 shifts the valve tappet 7.

If the stroke of the valve is to be reduced, the adjusting element 32 is reset, so that its end face has distance from the bottom 56 of the in the starting position located storage piston 24. If the tappet is pushed back through the cam 6, a part of the pressure medium can be displaced from the recording room 19 in the direction of the storage space 33. The pressure of the pressure medium is increased by moving the tappet push 7 so that it is greater than the force F1 of the compression spring 45. The storage piston 24 is moved until it is attached to the adjusting element 32.

As long as the pressure medium is displaced from the recording room 19 into the storage space 33, only the valve tappet shifts, but not the piston 11. Only when the storage space 33 is filled, the piston 11 with the valve shaft 10 is moved and thus the inlet/outlet opening 16 is opened. The stroke of the piston 11 is thus reduced. The degree of reduction of the valve stroke depends on the volume of the storage space 33. The larger it is, the more pressure medium is displaced from the recording room 19 before the piston 11 is moved.

The force F2 exerted on the piston 11 by the valve spring 9 is greater than the force F1 of the compression spring 45 of the adjustment accumulator 22. Thus, it is ensured that the piston 11 is only moved when the storage space 33 is filled with the pressure medium.

The springs 9, 45 also ensure that the piston 11 or the storage piston 24 are pushed back to their respective starting position. The valve tappet 7 is in the initial position under the force of the valve spring 9 or the tappet push spring 13 or the pressure medium located in the receiving chamber 19 at the base circle of the camshaft 5.

In order for the storage piston 24 to be moved correctly, in its coat section 43 at least one relief bore 57 is provided, which connects the ring space 46 with the breakout 36. This allows the air or pressure medium located in the ring space 46 to be removed when moving the storage piston 24 via the relief bore 57.

With the adjustment element 32, the volume of the storage space 33 can be continually adjusted. With the threaded spindle 28, a quick adjustment of the adjustment element 32 relative to the storage piston 24 is possible, so that the size of the storage space 33 can be adjusted according to the requirements. The adjustment can be done after a camshaft rotation, so that only little time is necessary for the adjustment. If it is not required dynamically, the adjustment can also be carried out slowly over several valve strokes.

The piston 11 is in the starting position, i.e. with closed inlet/outlet opening 16, in which in FIG. 2 shown position, in which the bottom 14 averted from the tappet bottom 11 flush with the free end face of the coat 12 of the tappet 7. Preferably, the piston 11 at the bottom 58 has a (not shown) stop, with which the starting position of the piston 11 is set. The force of the spring 13 is correspondingly smaller than the force of the spring 9, so that the piston 11 reliably enters its initial position.

The reception room 19 is filled with the medium conveyed by the pump 52, preferably motor oil. The pressure of the medium is exemplary about 2 to 3 bar. The valve spring 9 is designed so that it holds the valve tappet 7 as well as the piston 11 in the initial position, as long as the cam 6 of the camshaft 5 does not act on the valve tappet 7.

The position of the adjustment element 32 determines in the manner described how large the stroke of the valve is.

If the valve stroke is to be reduced, the adjusting element 32 is retracted by means of the threaded spindle 28. Since the medium acts on the bottom 56 of the storage piston 24 via the transverse line 50, it is pushed back against the force of the spring 45. Depending on the displacement distance of the storage piston 24, the volume of the storage space 33, into which a part of the pressure medium located in the recording room 19 flows. The larger the storage space 33, the more pressure medium can enter the storage space 33 from the receiving room 19 via the hole 21, the line 51 and the transverse line 50. With the adjustment element 32, it is continually and precisely determined how far the storage piston 24 can be retracted.

By the volume of the storage space 33, the volume of medium in the recording space 19 is reduced. As a result, the cam 6 initially shifts only the tappet 7, while the piston 11 stops. Only after a predetermined rotation angle of the camshaft 5 and a predetermined lifting distance of the valve tappet 7, the piston 11 is taken with it and thus lifted off via the valve shaft 10 of the valve plate 17 from the inlet/outlet opening 16. The lifting distance of the valve plate 17 or the valve shaft 10 is therefore correspondingly lower.

Depending on the size of the storage space 33 in the adjustment accumulator 22, the stroke of the piston 11 or the valve shaft 10 can be varied accordingly sensitively.

Leakage losses in the storage chamber 33 can be compensated by the pump 52 via the check valve 53 and the cross line 50 medium. Leakage losses in room 61 between the bottom 56 of the storage piston 24 and the upper area of the adjusting element 32 can be compensated by supplying pressure medium from the pump 52 via the connecting line 54 and the breakthrough 35. In the connection line 54 sits an aperture 55. The opening pressure of the check valve 38 in the radial bore 40 is as example as 0.5 bar or depends on the respective system requirements. The opening pressure of this check valve 38 is less than the pressure under which the medium is located.

The aperture 55 limits the flow through the check valve 38 into the damping chamber 61 and through the check valve 39. Since the check valve 39 also has a smaller opening pressure than the pressure medium, the oil lubrication pressure (for oil as a pressure medium) could be reduced or the volume flow for oil lubrication could be reduced too much and reduced for other components in the engine. If the flow through the check valve 38 were too high, the oil lubrication pressure of the engine could collapse, and the lubrication of the piston and bearings of the engine could no longer be sufficient. This would limit the life of these parts.

The piston 11, when the cam 6 has exceeded its 6 o'clock position, is retracted by the valve spring 9, wherein via the tappet spring 13 and the medium located in the receiving room 19 also the valve tappet 7 is returned, wherein it is always at the cam 6 attached. As soon as the valve plate 17 closes the in/outlet opening 16, only the valve tappet 7 through the tappet push spring 13 continues to the in FIG. 2 shown starting position. At the same time, the storage piston 24 is pushed back to its initial position. The compression spring 45 is set weaker than the valve spring 9, for example about 10 to 20 percent lower. However, the spring force of the compression spring 45 is designed so that it can hold the storage energy, determined by the pressurized medium located in the storage space 33.

The cylindrical end portion 49 of the adjusting element 32 has an external diameter, which is smaller than the inner diameter of the thickened area 42 of the storage piston 24. Thus, in the area between the end portion 49 and the thickened coat section 42 a ring space 60 is formed. It is used for end position damping when the bottom 56 of the storage piston 24 hits at the end section 49. The medium located in the ring space 60 dampens the impact, so that a bouncing as well as mechanical impacts and pressure peaks are avoided.

The ring space 60 extends to the transition from the cone section 48 to the one in FIG. 2 lower cylindrical section 47 of the adjusting element 32. Thus, the radial width of the ring space 60 in the area of the cone section 48 decreases steadily in the direction of the cylindrical section 47.

In the position according to FIG. 2 the storage piston 24 is shown in an intermediate position. The radial holes 40, 41 lie at the level of the cone section 48 of the adjustment element 32. Thus, via the check valve 38 medium can enter the room 61 between the bottom 56 of the storage piston 24 and the upper area of the adjusting element 32. When moving the storage piston, the medium located in room 61 is displaced at least partially via the radial bore 41 and the check valve 39.

If the end portion 49 of the adjustment element 32 conical or co-rejuvenating is formed, in combination with the inner diameter of the storage piston 24 a damping can be achieved in order to reduce the adjustment speed or the hitting on the ceiling 25 reduce or dampen.

The described adjustment of the adjustment element 32 is carried out mechanically via the threaded spindle 28, which is driven by means of the adjustment motor 31. For example, the adjusting motor can be a stepper motor with which the threaded spindle can be rotated exactly and within a very short time. The steering or control of the adjustment motor 31 can be carried out via a path sensor in the adjustment accumulator 22. The path sensor detects the position of the adjusting element 32 or the storage piston 24. For steering or control, e.g. hall sensors can also be used in the adjusting motor 31.

Figure 2A:
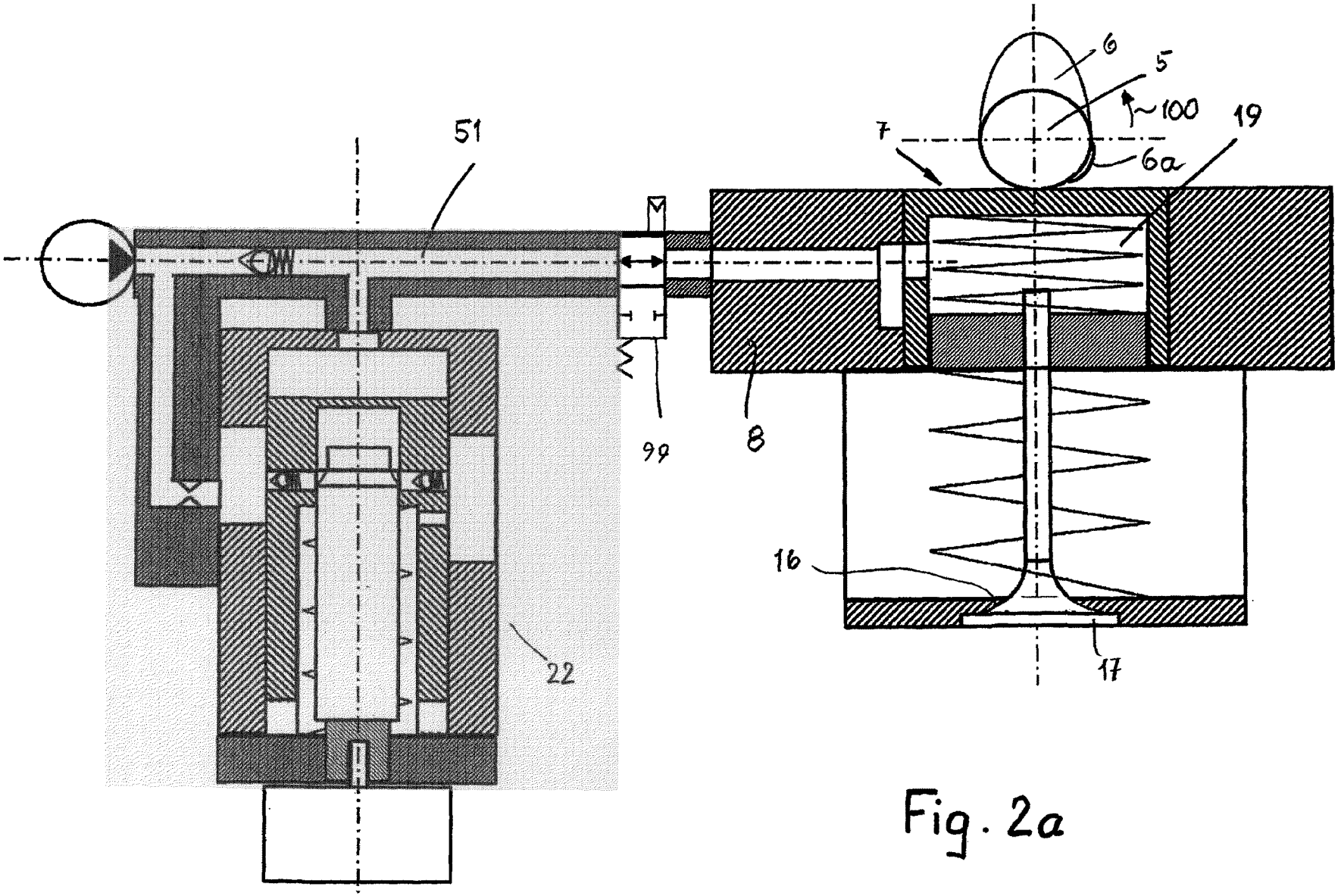

FIG. 2*a* shows an embodiment, which is different from the embodiment according to FIG. 2 distinguishes in that in the line 51 between the cylinder head 8 with the valve tappet 7 and the adjustment accumulator 22 sits a switching valve 99. This switching valve 99 is located in FIG. 2*a* in the open position. Then the device works, as if on the basis of FIG. 2 has been described in detail.

The camshaft 5 is equipped with an additional cam 6*a*, which has a much lower height than the cam 6. If the camshaft turns in the direction of the drawn arrow 100, then the additional cam 6*a* comes into contact with the tappet 7 only when the cam 6 has just left the tappet 7. The additional cam 6*a* leads to a low downstream second stroke of the valve tappet 7 and thus of the entire motor valve. This second additional stroke allows internal exhaust gas recirculation.

To enable this additional stroke, the switching valve 99 is closed. The medium located in the receiving room 19 of the tappet cannot be displaced, so that with the additional smaller stroke of the valve plate 17 the inlet/outlet opening 16 opens slightly to allow the return of the exhaust gases from the respective combustion chamber.

With the help of the switching valve 99 it is thus possible to perform a second hydraulically controlled opening stroke of the engine valve for internal exhaust gas recirculation. This can reduce or save other devices, such as an additional exhaust gas recirculation valve and the corresponding coolers.

Figure 2B:
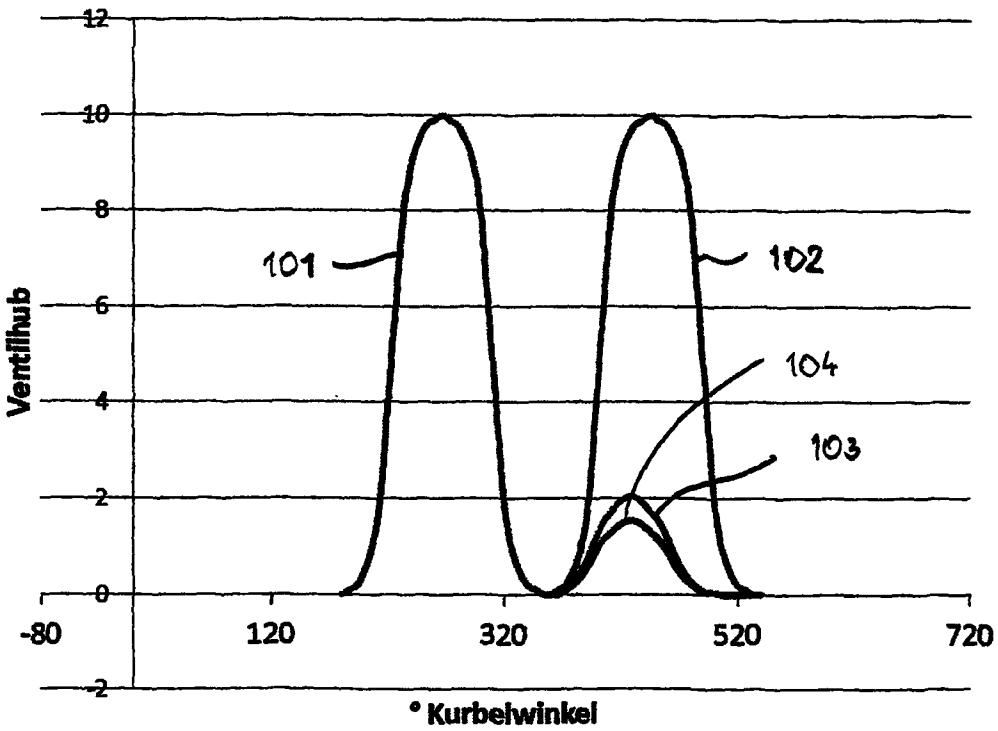

FIG. 2*b* shows the corresponding stroke progressing curves. Curve 101 indicates the valve stroke of the outlet valve and the curve 102 indicates the lifting curve of the inlet valve.

The stroke curves 103, 104 indicate the second opening of the outlet valve, while the inlet valve (stroke curve 102) is also open.

The additional second stroke achieves the additional advantage that the engine heating can be achieved faster due to the short exhaust gas recirculation and the exhaust emissions are reduced by controlled control of the exhaust gas recirculation.

In the described manner, the valve stroke characteristic can be characterized by a formation according to FIG. 2*a* via the adjustment accumulator 22 and the switching valves 99 as well as the additional cams 6*a*. With the additional cams 6*a* and the switching valves 99, there is a significant improvement in combustion due to different opening timing and opening positions of the valves.

Figure 3:
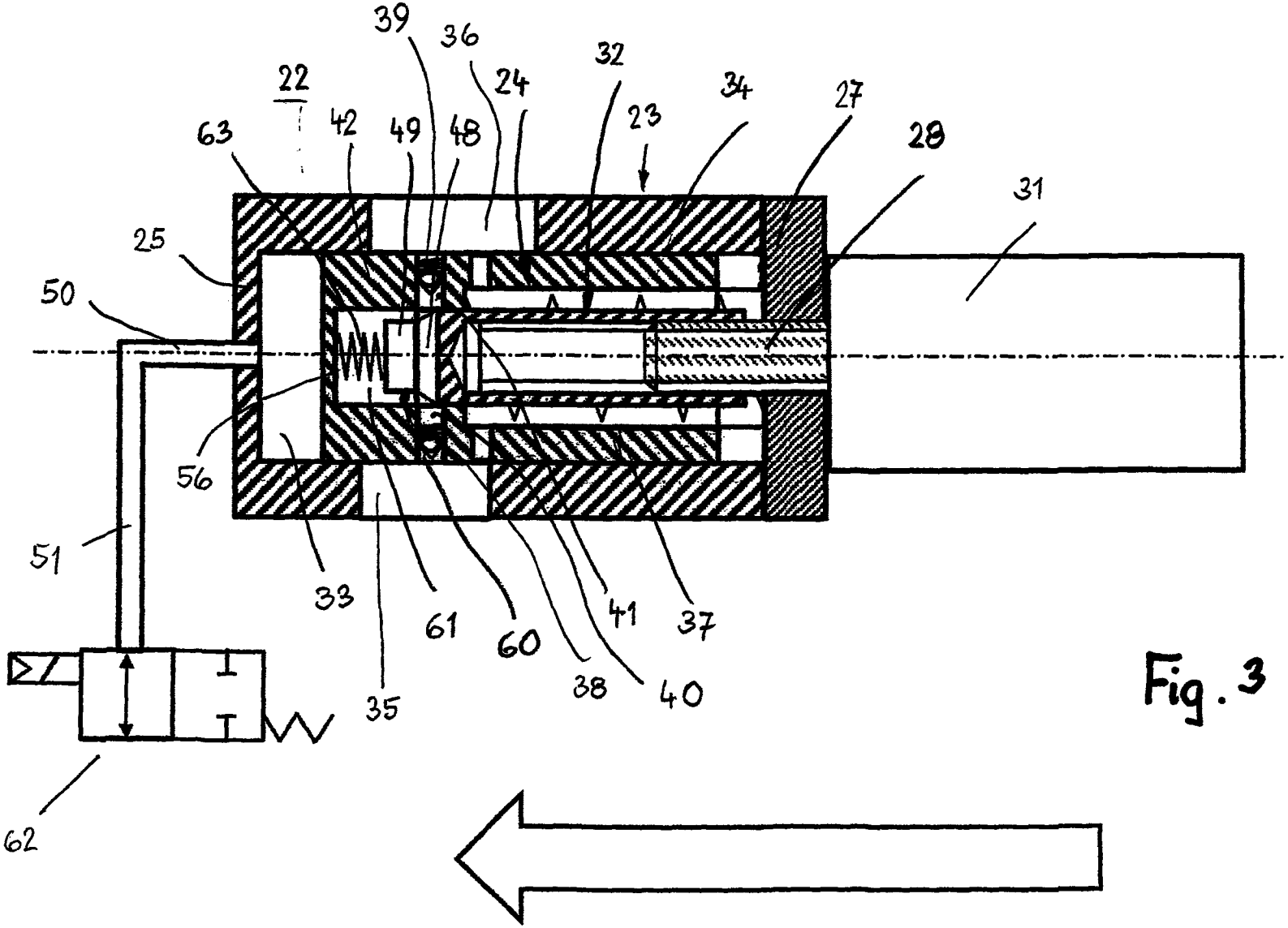

FIG. 3 shows an adjustment accumulator 22, which is basically the same as in the previous embodiment. It has the housing 23 with the cylindrical coat 34, on whose inner wall the storage piston 24 is sealed. In the storage piston 24, the adjusting element 32, which sits on the threaded spindle 28, protrudes. It is mounted in the cover plate 27 rotatable, which closes the housing 23 at one end. At the other end, the case 23 is closed by the ceiling 25.

The threaded spindle 28 is driven rotatably with the adjusting motor 31.

The transverse line 50, in which a valve 62 sits, flows into the storage space 33 between the housing ceiling 25 and the bottom 56 of the storage piston 24.

In contrast to the previous embodiment, in room 61 between the cylindrical end portion 49 of the adjusting element 32 and the bottom 56 of the storage piston 24 a compression spring 63 is housed, which is formed in the embodiment as a coil compression spring and as an dampening (attenuation) spring. The compression spring 63 can also affect the lifting curve of the motor to derive further advantages for the motor.

The valve stroke curves can have different shapes. For example, the valve stroke curve can be approximately rectangular. With such a design of the valve stroke curves, significantly more air or fuel air mixture will enter the engine. With such valve stroke curves, the valve strokes can also be shortened with the same air flow rate. Then less moving masses are required, resulting in better dynamics.

The room 61 forms as in the previous embodiment a damping chamber, by which a hard hitting of the bottom 56 of the storage piston 24 at the end side of the adjustment element 32 is prevented. The ring space 60, which is arranged between the cylindrical end section 49 and the cone portion 48 of the adjustment element 32 and the thickened area 42 of the cylindrical liner 37 of the storage piston 24, also contributes to the damping. The coat surface of the cone section 48 forms a The damping cone 48 is designed so that its mantle passes into the mantle of the end portion 49 of the adjustment element 32. The damping slant 48 can be further adjusted via the running play between the adjustment element 32 and the inner diameter of the area. Thus, the reciprocity of the storage piston 24 as well as the motor valve can also be changed and influenced.

The breakout 36 connects according to the previous embodiment the adjustment accumulator 22 with the (not shown) engine oil tank.

The radial bore 41, in which the check valve 39 is located, flows into the thru hole 3 at each position of the storage piston 24.

The radially opposite break thru 3 in the coat 34 of the housing 23 ensures, as in the previous embodiment, that leaks can be easily compensated.

The opening pressure of the check valve 38 is smaller than the engine oil pressure. Thus, oil can flow into the damping chamber, which was previously displaced by a piston stroke. It also prevents pressure waves from flowing back into the pressure line of the oil lubrication pump during active storage dynamics. Depending on the lubricating oil system, this valve could also be omitted. The check valve 39 is used for independent emptying of the damping chamber, especially when the storage devices are arranged at a high position in the engine/vehicle (system). The pressure is set lower than the check valve 38. This ensures a flow through and the venting of the damping chamber 61. A higher pressure of the check valve 39 prevents a permanent oil flow and thus a reduced amount of oil for the oil lubrication pump. The venting of the damping chamber 61 takes place either during the initial filling or via several targeted storage strokes.

If, for example, the oil pans are installed directly in the oil pan below the oil level or are permanently under flowing oil, the check valves can be dispensed with.

The position, diameter and shape of the radial bore 38 is chosen in such a way that the refilling of the damping chamber 61 is guaranteed at each stroke.

The breakthrough 35 is corresponding to the previous embodiment in the centrifugal direction of the storage piston 24 so long that the radial bore 40 in each reciprocity of the storage piston 24 is connected with the break thru 35 conduction.

The adjustment accumulator 22 according to FIG. 3 works in the same way as the previous embodiment, so that the embodiments with respect to the previous embodiment can be referred to.

The valve 62 sits in the line 51, over which the adjustment accumulator 22 to the one in FIG. 3 pump 52, which is not shown, are connected. In addition, the connection between valves 1 to 4 and the adjustment accumulator 22 is established via the valve 62.

The valve 62 is open during the use of the adjusting device. In an emergency, the valve 62 is closed. It forms a failsafe valve.

Figure 4:
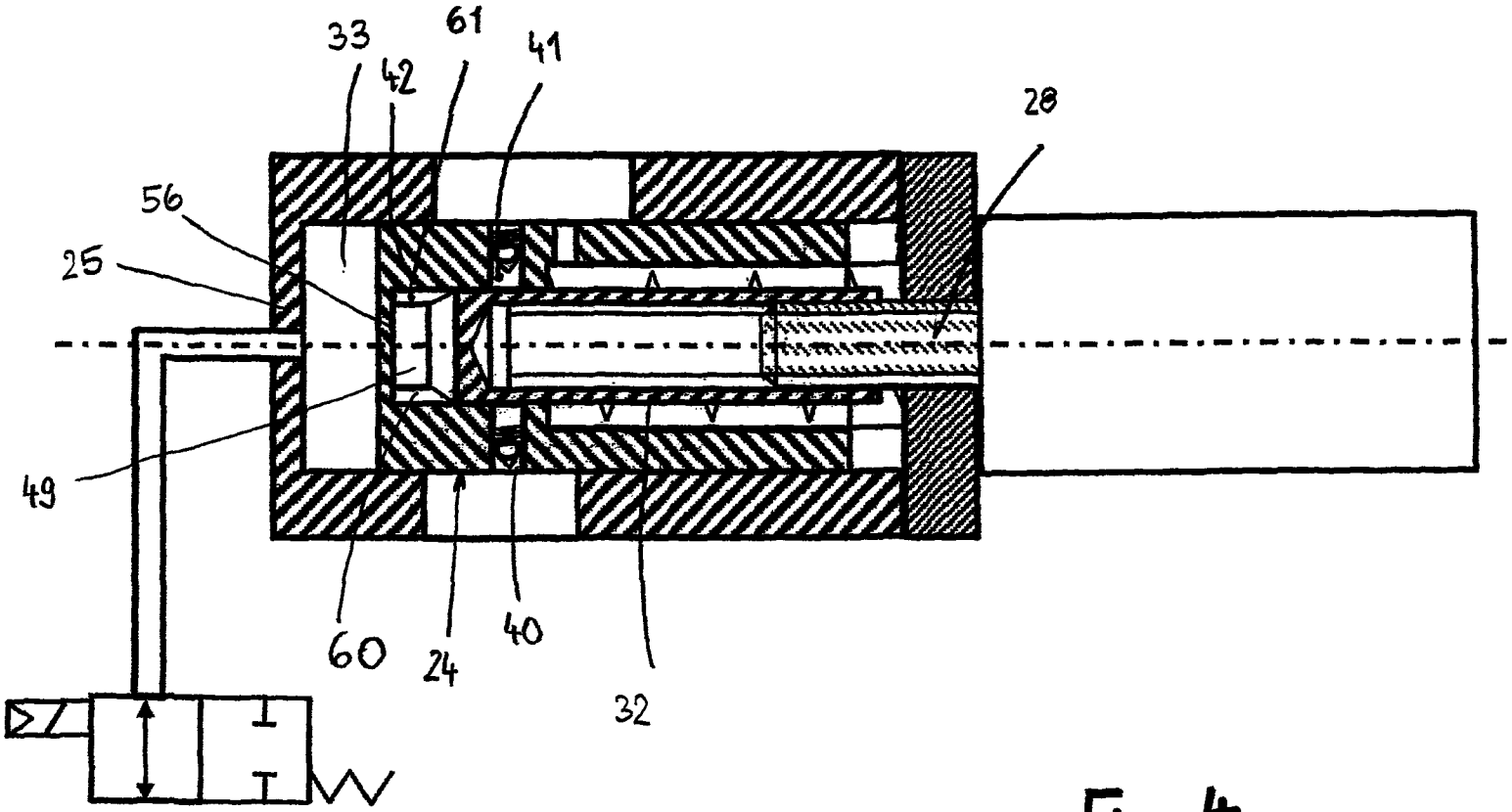

FIG. 4 shows the situation in which the storage piston 24 with its bottom 56 is attached to the end of the cylindrical end section 49 of the adjustment element 32. Here, the bottom 56 has distance from the housing ceiling 25, whereby between it and the storage piston 24 the storage space 33 is formed, whose volume determines how large the stroke of the respective valve is.

In this position, the radial holes 40, 41 of the storage piston 24 are closed by the adjusting element 32. The pressure medium in the damping chamber 61 was displaced via the gap between the area 42 of the storage piston 24 and the adjustment element 32.

In the position according to FIG. 5 the adjustment element 32 is shifted so far that it is located on the bottom 56 of the storage piston 25 attached to the housing ceiling 25. The medium is displaced via the gap as a leakage, whereby the upcoming pressure supports this process.

Since in this position the storage space 33 has a volume zero, the respective valve performs its maximum possible stroke in the described manner.

If the adjustment element 32 is retracted, the room 60 can then be filled again with the medium as soon as the hole 40 is released again.

Figure 5A:
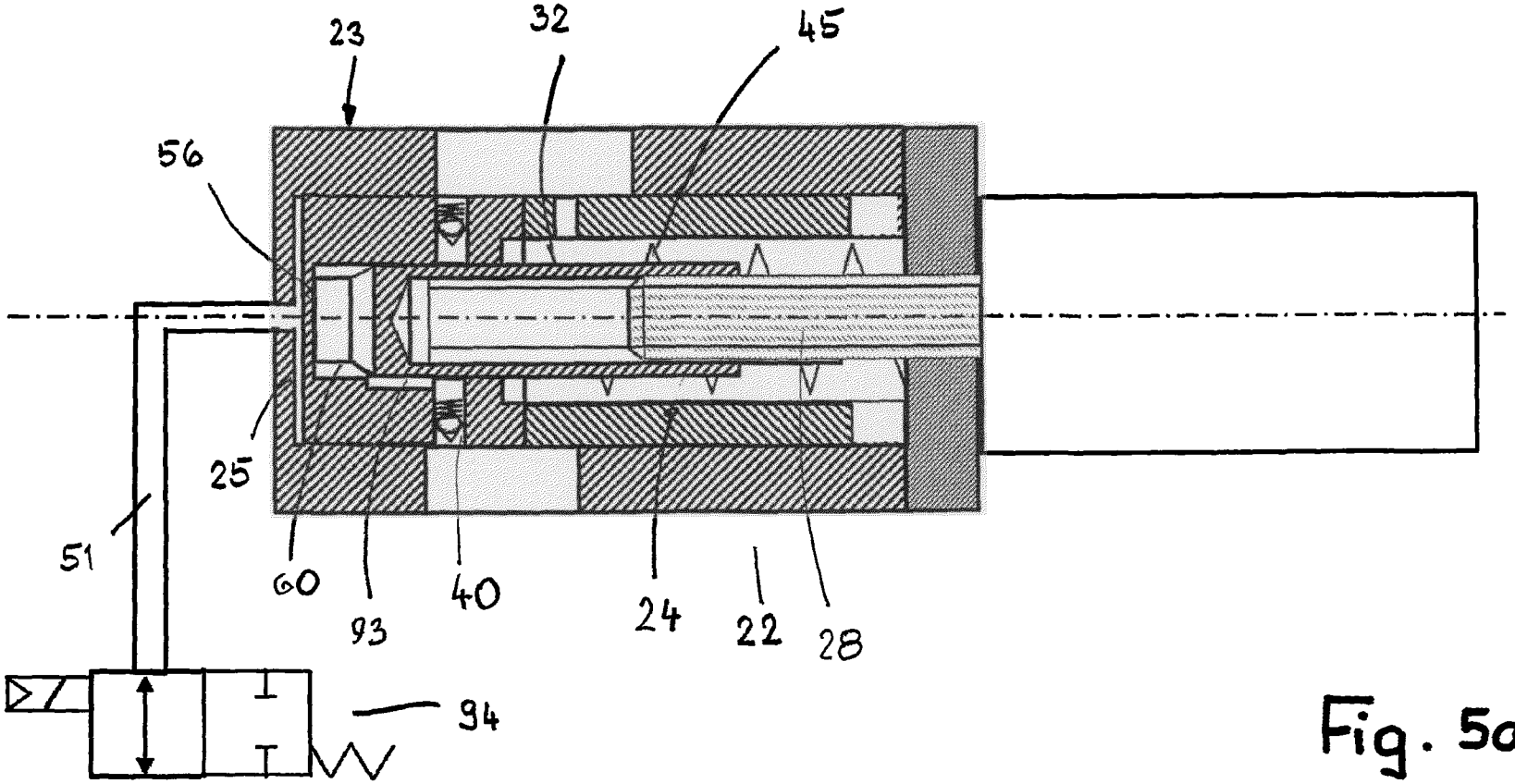

FIG. 5*a* shows a variant of the FIG. 5, in which the room 60 is filled from the beginning of the back stroke of the adjustment element 32 with the medium via the hole 40. The hole 40 is via at least one axial channel 93 or an axial bore connected to room 60 when the adjusting element 32 with its bottom 56 is attached to the ceiling 25 of the housing 23. This results in continuous ventilation of room 60.

Incidentally, the adjustment accumulator is formed equal as the embodiment according to FIG. 5.

In the described embodiments, the adjustment element 32 against rotation on the threaded spindle 28 is secured in a known manner, for example by a pass spring (locking device), so that it is reliably axially shifted when turning the threaded spindle 28.

A fail-safe valve 94 (FIGS. 5 and 5*a*) sits in the line 51 leading to the valve tappet 7. In normal operation, this valve 94 is opened, so that the medium can reach the adjustment accumulator 22 in the manner described. In the event of a failure of the mechanical or hydraulic drive for the adjusting element 32, the compression spring 45 is designed so that the storage piston 24 in its in FIG. 5 or 5*a* shown end position is moved. Then the motor valve 1 to 4 can execute its stroke specified by the camshaft 5 in the manner described. The valve 94 is closed in such a situation, so that the adjustment accumulator 22 is separated from the system. In this case, a stroke size adjustment of the motor valves is not possible.

Figure 6:
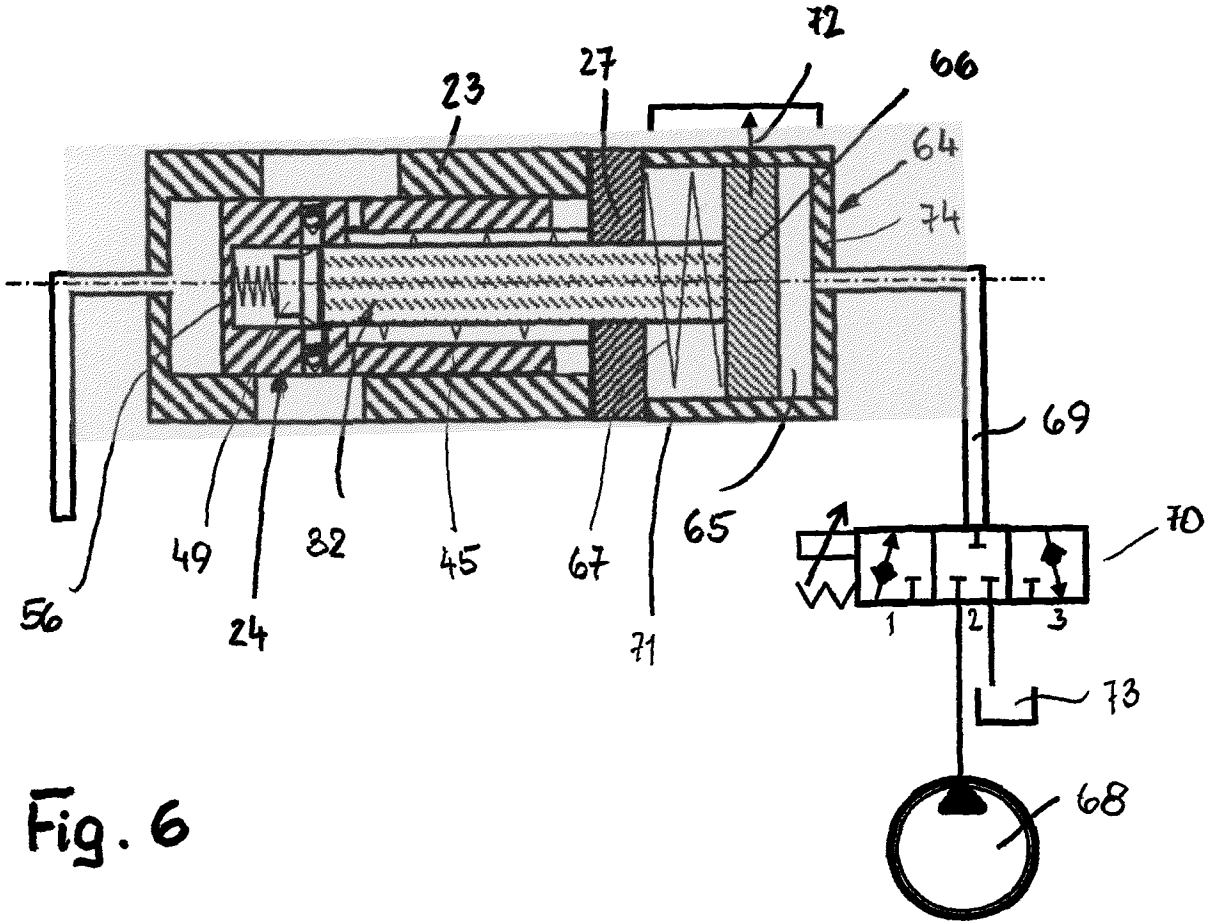

FIG. 6 shows an embodiment in which a hydraulic drive 64 is provided instead of the mechanical drive for the adjusting element 32. It has a piston 66 movable in a cylinder space, on whose cover disc 27 of the housing 23 facing the side of the adjustment element 32 with its one end is attached to it. In the area between the cover plate 27 and the piston 66, the adjusting element 32 is surrounded by at least one compression spring 67 with distance, which is, for example, a coil spring.

The piston 66 is applied on its opposite side by a pressure medium, which enters the cylinder space 65 from a pump 68 via a line 69. In the line 69 sits a proportional valve 70, with which the medium, preferably oil, can be supplied.

The structure and the mode of action of the adjustment accumulator 22 corresponds to the previous embodiments. The difference is only in the formation of the drive for the adjustment element 32. In the embodiment according to FIG. 6 it is axially shifted by impacting the piston 66, which is sealed in a housing connected to the cover disc 27. The axial adjustment path is monitored by a path sensor 72, which is schematically represented by an arrow.

Advantageously, the path sensor 72 is connected to a (not shown) controller which evaluates the path signals and controls the pump 68 and the valve 70 in such a way that the piston 66 executes the required adjustment path. In the in FIG. 6 shown position, the proportional valve 70 locks the connection between the cylinder space 65 and the pump 68, so that the piston 66 remains in its set position.

If the piston 66 is to be returned to its initial position, the proportional valve 70 is switched to the position 3, so that the piston 66 is retracted by the compression spring 67, wherein the medium located in the cylinder space 65 via the line 69 back to the tank 73 is managed. In the output position, the piston 66 is located on the bottom 74 of the housing 71.

If the piston 66 is to be moved from the initial position, the valve or proportional valve 70 is adjusted to the position 1, so that the medium from the pump 68 enters the line 69 and from there into the cylinder space 65.

In the event of a failure of the control current to the valve 70, the compression spring 45 ensures that the storage piston 24 in FIG. 6 is moved to the left in its final position. This ensures that the respective motor valve 1 to 4 (FIG. 1) in the manner described can reach his maximum stroke. The compression spring 45 is build/designed accordingly.

Figure 6A:
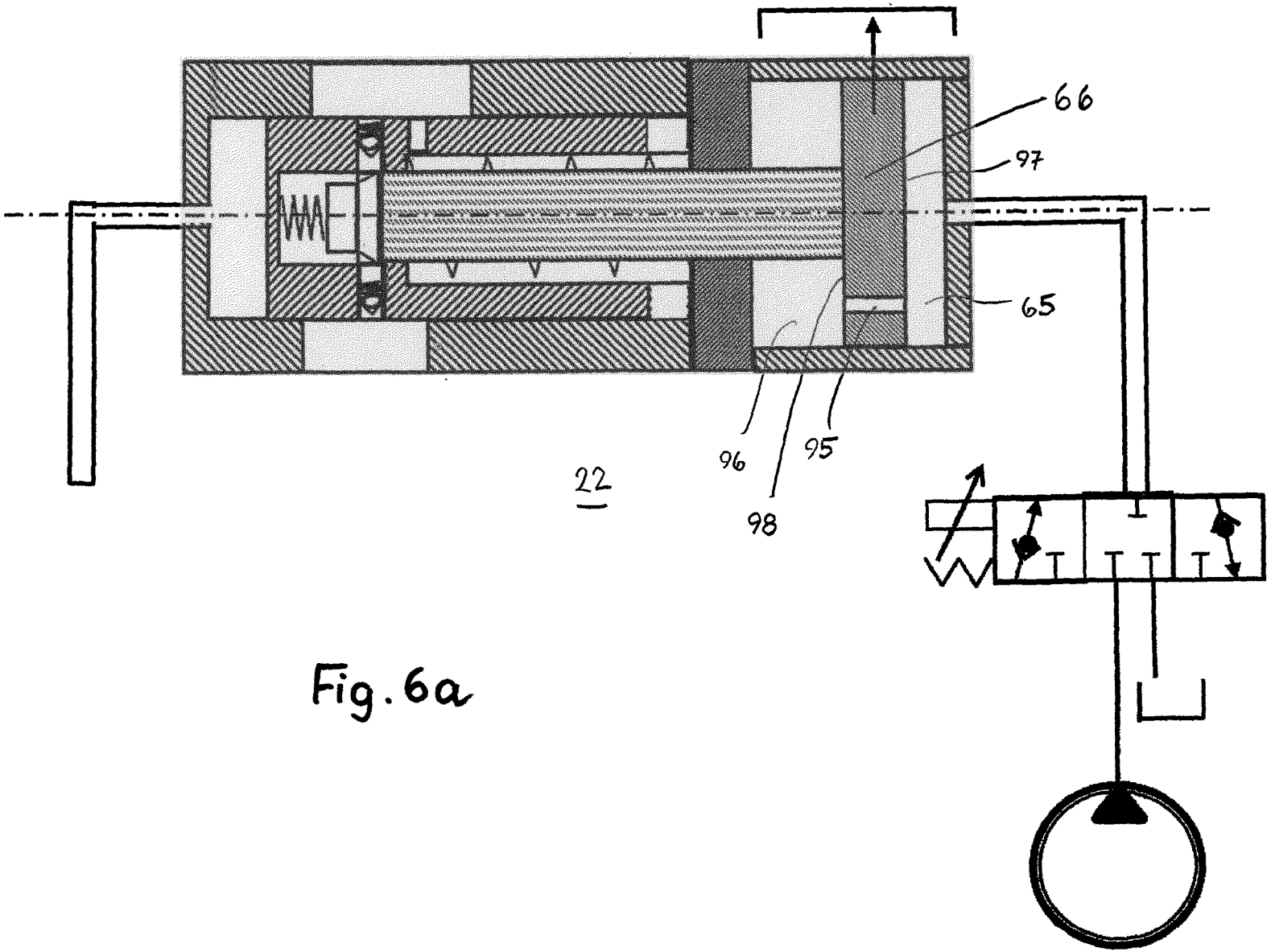

FIG. 6*a* shows an embodiment of an adjustment accumulator 22, which is substantially the same as the embodiment according to FIG. 6. The difference is that the piston 66 is applied on both sides with pressure medium. The compression spring 67, which is used in the embodiment according to FIG. 6 is provided for, thereby no longer necessary. The piston 66 is provided with at least one penetration opening 95. Via this passage opening 95, the cylinder space 65 is connected to the opposite cylinder space 96.

The piston 66 forms a pressure differential piston. The piston surface 97 limiting the cylinder space 65 is larger than the opposite piston surface 98.

Since the piston 66 is clamped from both sides by means of hydraulic pressure, it can be fixed very stable.

The mode of action of the adjustment accumulator 22 corresponds, moreover, to the mode of action of the adjustment accumulator according to FIG. 6.

FIG. 1 shows how to operate multiple valves 1 to 4 with a single adjustment accumulator 22. The adjustment accumulator 22, which in the embodiment a design according to FIG. 3, is connected via line 51 to a collection line 75. A transverse line 76 to 79 is connected to them, in which each one lock valve 80 sits. From the transverse lines 76 to 79 branches off the line 51, which is connected in the described manner to the respective valves 1 to 4.

The transverse lines 76 to 79 are connected to another collection line 81, which in turn is connected to the pump 52, with which medium, preferably motor oil, can be conveyed. The transverse lines 76 to 79 are secured against the collective line 81 by a check valve 83. The check valves 83 open in the direction to the transverse lines 76 to 79, so that medium can be conveyed from the pump 52 into the transverse lines 76 to 79.

The collection line 75 is connected to the pump 52, with which advantageous motor oil can be conveyed.

With the adjustment accumulator 22, the stroke of the valves 1 to 4 (FIG. 1) can be continually adjusted. This device is suitable for motor valves where the valve function does not overlap. This means that the individual valves 1 to 4 are operated in succession. To ensure this, the locking valves 80 are provided, each of which is switched so that only one of the valves 1 to 4 is connected to the adjustment accumulator 22 conduction.

In the embodiment shown, the locking valve 80 assigned to the valve 3 is opened, while the locking valves 80 of the other valves 1, 2 and 4 are closed. Thus, the stroke of the valve 3 is adjusted in the written manner with the help of the adjustment accumulator 22. FIG. 1 shows that the valve tappet 7 of the valve 3 has been adjusted by the cam 6 of the camshaft 5, so that the inlet/outlet opening 16 is opened. The other inlet/outlet openings 16 are closed by the corresponding valve plates 17.

As soon as the lifting process of the valve 3 is finished, the corresponding shut-off valve 80 is closed via a (not shown) control and the shut-off valve 80 of the valve 2 is opened. If the camshaft 5 rotates clockwise, the valve tappet 7 of the valve 2 is now actuated by the cam 6. As soon as the cam 6 of the valve tappet 7 of the valve 2 is released again, the corresponding shut-off valve 80 is closed and now the shut-off valve 80 of the valve 1 is opened.

In the described manner, the blocking valves 80 of the valves 1 to 4 are opened sequentially and thus connected to the adjustment accumulator 22 conduction. For each valve 1 to 4, the stroke distance may be different, depending on the requirements of the internal combustion engine.

Since the valves 1 to 4 are operated in time one after the other, a single adjustment accumulator 22 for the individual valves 1 to 4 is sufficient. An example of this is a pure engine brake for engines.

Figure 7:
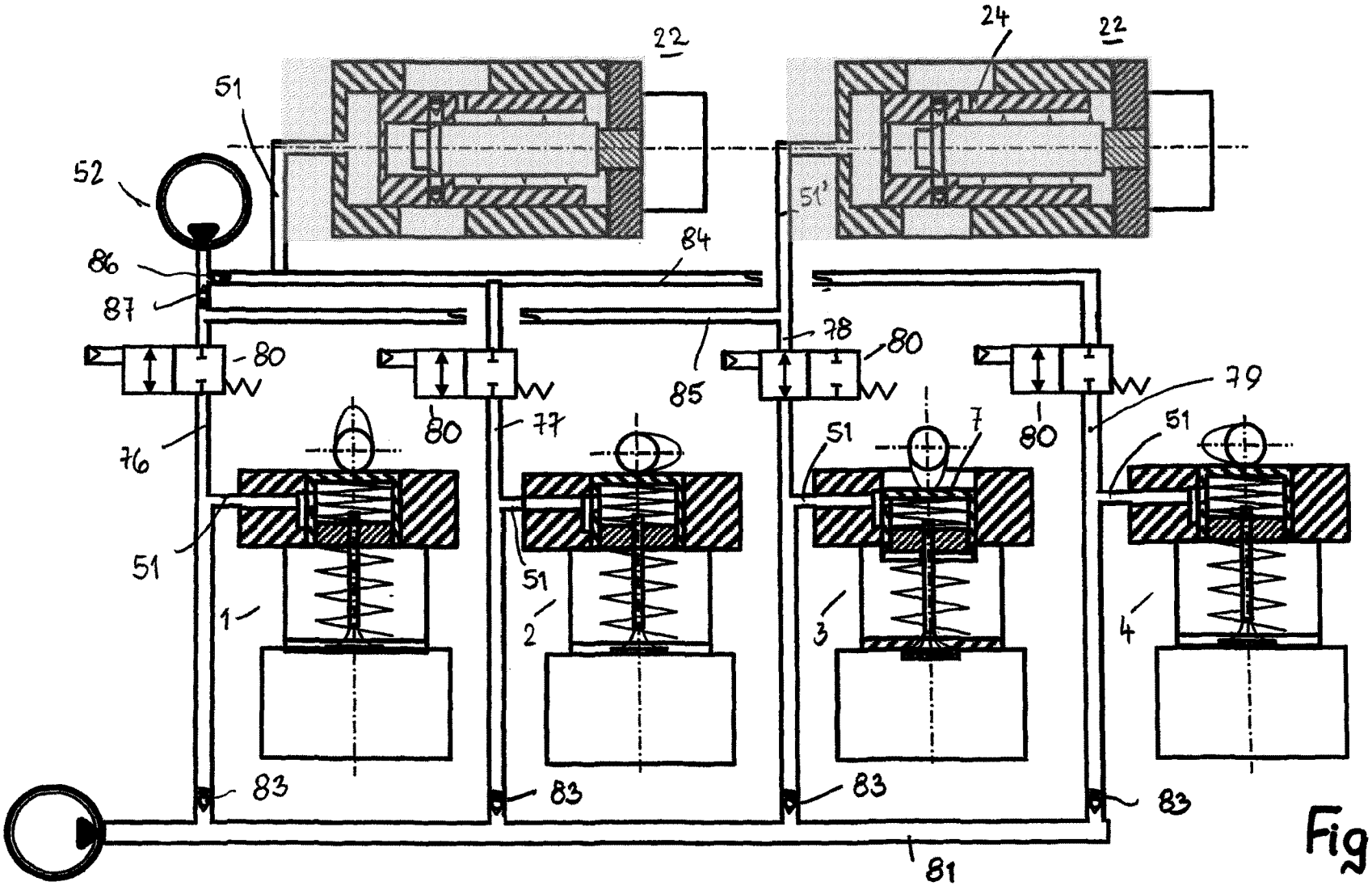

If, on the other hand, a valve overlap is to be provided during the operation of the internal combustion engine, then a device according to FIG. 7 can be used. With this, it is possible to control the individual valves 1 to 4 in such a way that the stroke of one valve is initiated while the stroke of another valve is shortly before the termination.

The valve overlaps are used in the classic motor control system. In this case, the device has for example two adjustment accumulator 22, which are advantageously equally designed. As with the version according to FIG. 6 the adjustment accumulator 22 can have a design, as they are based on the FIGS. 1 to 5 has been described. Valves 1 to 4 are connected via the lines 51, 51 to the transverse lines 76 to 79. In each of them sits the locking valve 80.

In the area between the shut-off valve 80 of the valve 1 and the pump 52, two collection lines 84, 85 are connected to the transverse line 76. The cross lines 76, 77 and 79 branch off from the collection line 84. The cross lines 76 and 78 branch off from the collection line 85.

To the collection line 84 is connected via the line 51 of the one adjustment accumulator 22 and to the collection line 85 via the line 51' the other adjustment accumulator 22.

Further, the device is formed in the same way as the embodiment according to FIG. 1.

In the embodiment shown, the blocking valve 80 of the valve 3 is opened, so that this valve 3 with the in FIG. 7 right adjustment accumulator 22 is connected to the line. Thus, in the manner described, the stroke of the valve 3 can be adjusted. The locking valves 80 of the valves 1, 2 and 4 are closed.

Since two adjustment accumulators 22 are provided, the locking valve 80 of the valve 2 can be opened already if the valve tappet 7 of the valve 3 is on its return stroke but has not yet reached its end position. By opening the shut-off valve 80 of the valve 2, this is connected via the collective line 84 and the line 51 with the left adjustment accumulator 22, so that with it the stroke of the valve 2 can be adjusted.

Both adjustment accumulators 22 operate independently of each other, so that two valves 1 to 4 can be controlled in such a way that they have overlaps in their lifting movement. The degree of overlap depends on the ignition sequence of the individual cylinders of the combustion engine.

The collection line 84 is locked against the pump 52, which can be, for example, a motor oil lubrication pump or a comparable pump, by a check valve 86. The collection line 85 is also blocked by a check valve 87 against the pump 52.

Figure 8:
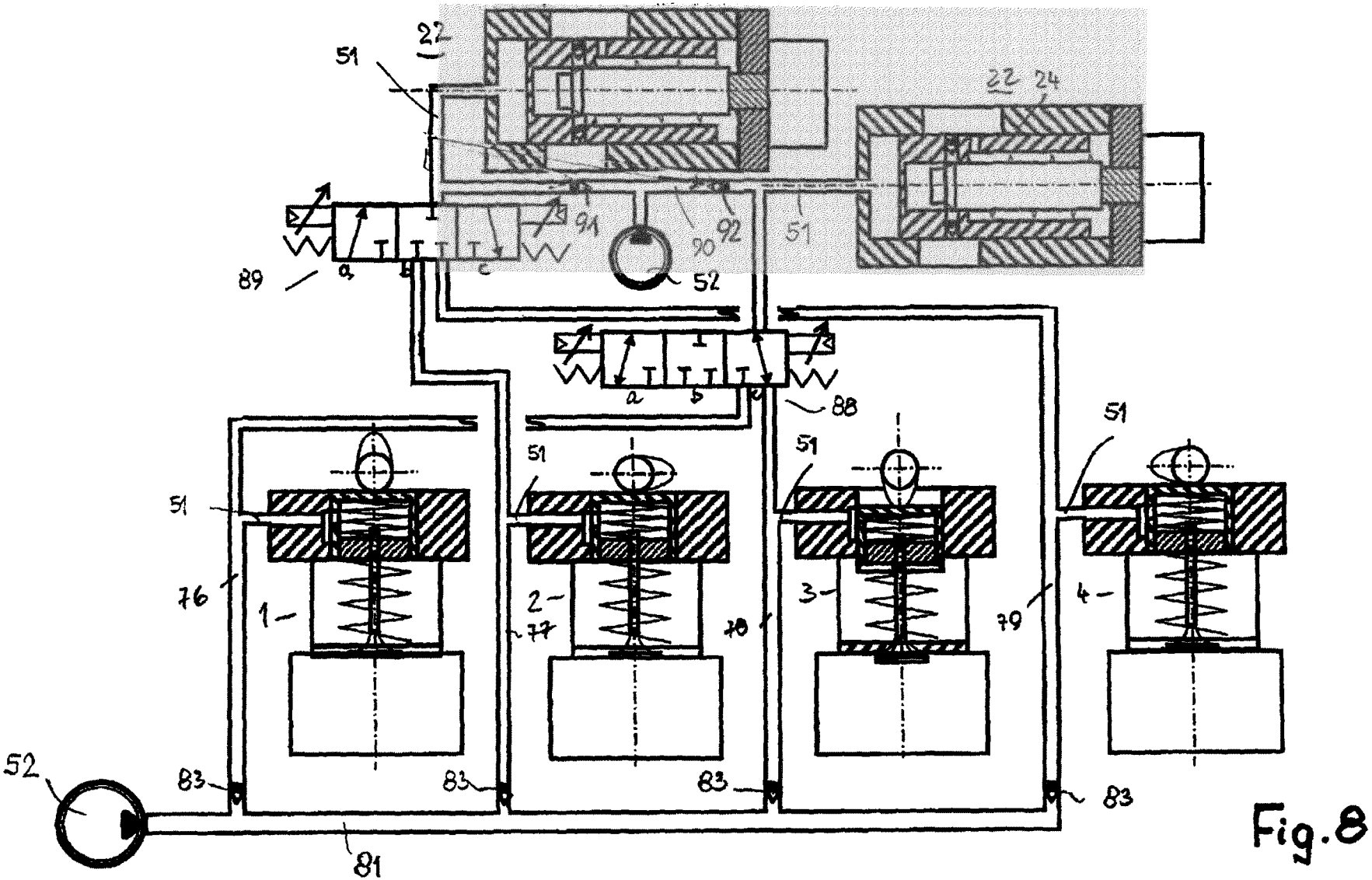

FIG. 8 shows another embodiment of a device with two adjustment accumulators 22, so that with this device also valve overlaps are possible. The two adjustment accumulators 22 are equally formed and can be formed according to the previous embodiments. The two adjustment accumulators 22 can be connected to the valves 1 to 4.

The device has the collection line 81, which is connected to the pump 52 and from which the cross lines branch 76 to 79 are connected. In the transverse lines 76 to 79 sits the check valve 83, which locks against the collection line 81. The transverse lines 76 to 79 are connected via the branching lines 51 to the respective valves 1 to 4 in the written manner.

The two transverse lines 76, 78 are connected to a proportional valve 88 and the transverse lines 77, 79 to a proportional valve 89. With the proportional valves 88, 89, the valve stroke curves of the motor valve can be influenced or thus targeted curves can be shown.

Figure 9:
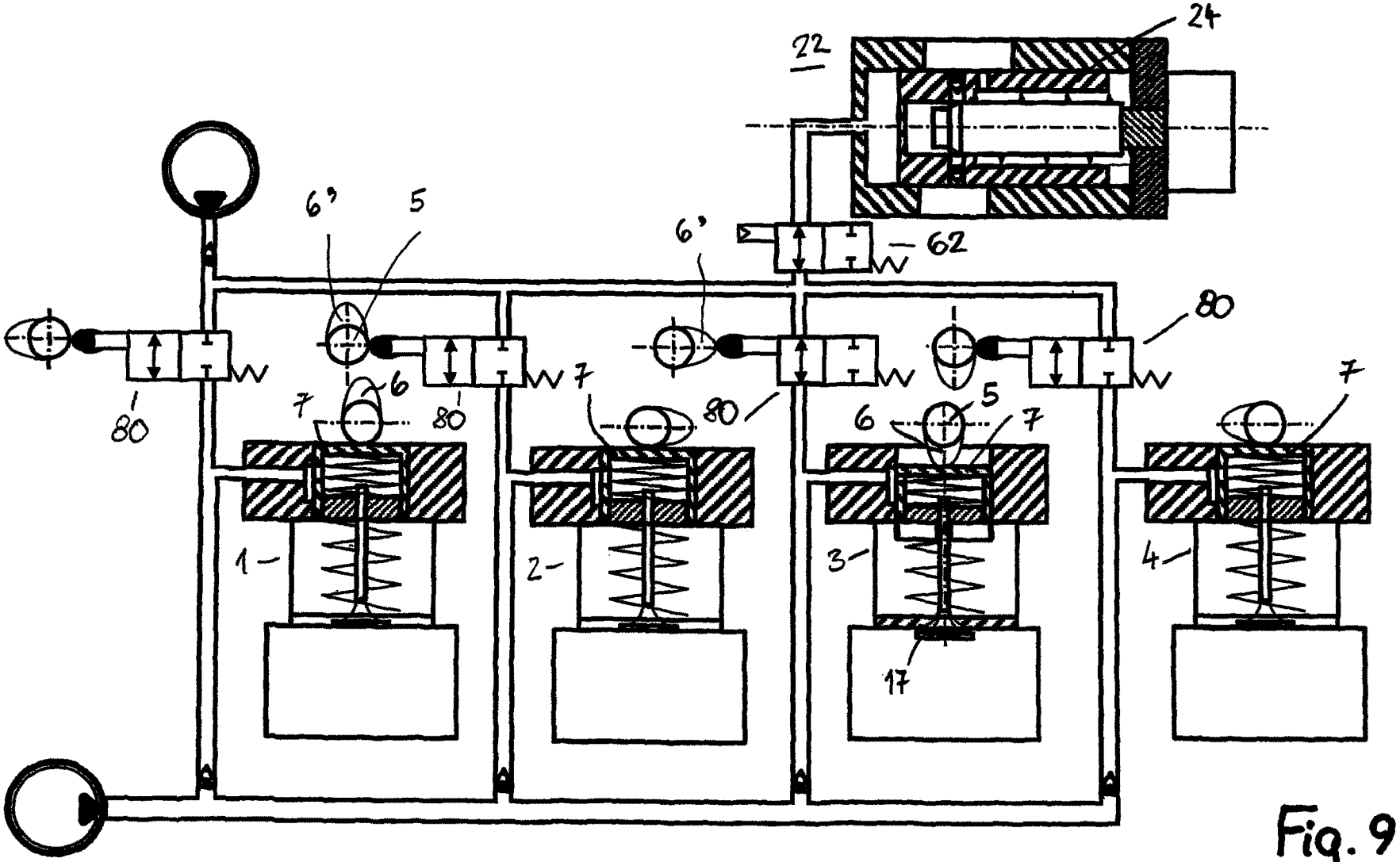

The adjusting device according to FIG. 9 corresponds essentially to the embodiment according to FIG. 1. The difference is that the locking valves 80 are not operated by a control, but by mechanical control. For this purpose, the camshaft 5, which is provided with cam6', with which the corresponding locking valves 80 are operated. The actuating cams 6 are advantageously arranged in the same way as the valve tappets 7 of the valves 1 to 4 actuating cams 6. For the execution example according to FIG. 9 the locking valve 80 of the valve 3 is in the open position. The cam 6 has adjusted this shut-off valve 80 to the open position. The cam 6 of the camshaft 5 shifts the tappet 7. The stroke of the valve plate 17 depends on the position of the storage piston 24 of the adjustment accumulator 22, as has been described in detail above.

In this embodiment, the valves 1 to 4 can only be operated in one after the other. A valve overlap, as is possible with the embodiments with two adjustment accumulators 22, cannot be performed with the device according to FIG. 9. Using two adjustment accumulator 22 as in the embodiment according to FIG. 7, an overlap of the opening and closing of the motor valves is also possible in this embodiment.

In the described embodiments, the adjustment accumulator 22 for the inlet and the outlet valves can be used in parallel. If no valve overlaps are provided, the adjustment accumulator 22 for four valve 1 to 4 can be used if it is, for example, a four-cylinder engine. Depending on the number of cylinders, an adjustment accumulator 22 can also be used for more than four valves.

If valve overlaps are provided, two adjustment accumulators 22 can be used in a four-cylinder engine, as previously described as an example. If the internal combustion engine has more than four cylinders, for example six cylinders, then three adjustment accumulators can be used. When using the Safe Fail Valve 62 it is ensured that in the event of a failure of the adjustment motor 31 or the hydraulic drive 64, the adjustment accumulator 22 is separated from the valve. The valve 1 to 4 can then carry out its stroke specified by the camshaft.

By the described end position damping by means of the medium located in space 61 or in the ring space 60 of the adjustment accumulator 22, the inlet and the outlet form of the valve stroke curve can be changed. The end position damping can also be achieved by the compression spring 63, which is underused in room 61. If the attenuation is low, the valve stroke curve is mapped exactly. With higher attenuation, on the other hand, there is a harmonious transition.

For example, a pressure limiting valve can be used to limit the pressure of the storage system, which disconnects the pressure to the tank for safety. Such a pressure limiting valve can, for example, sit in the line 75 (FIG. 1).

Figure 10:
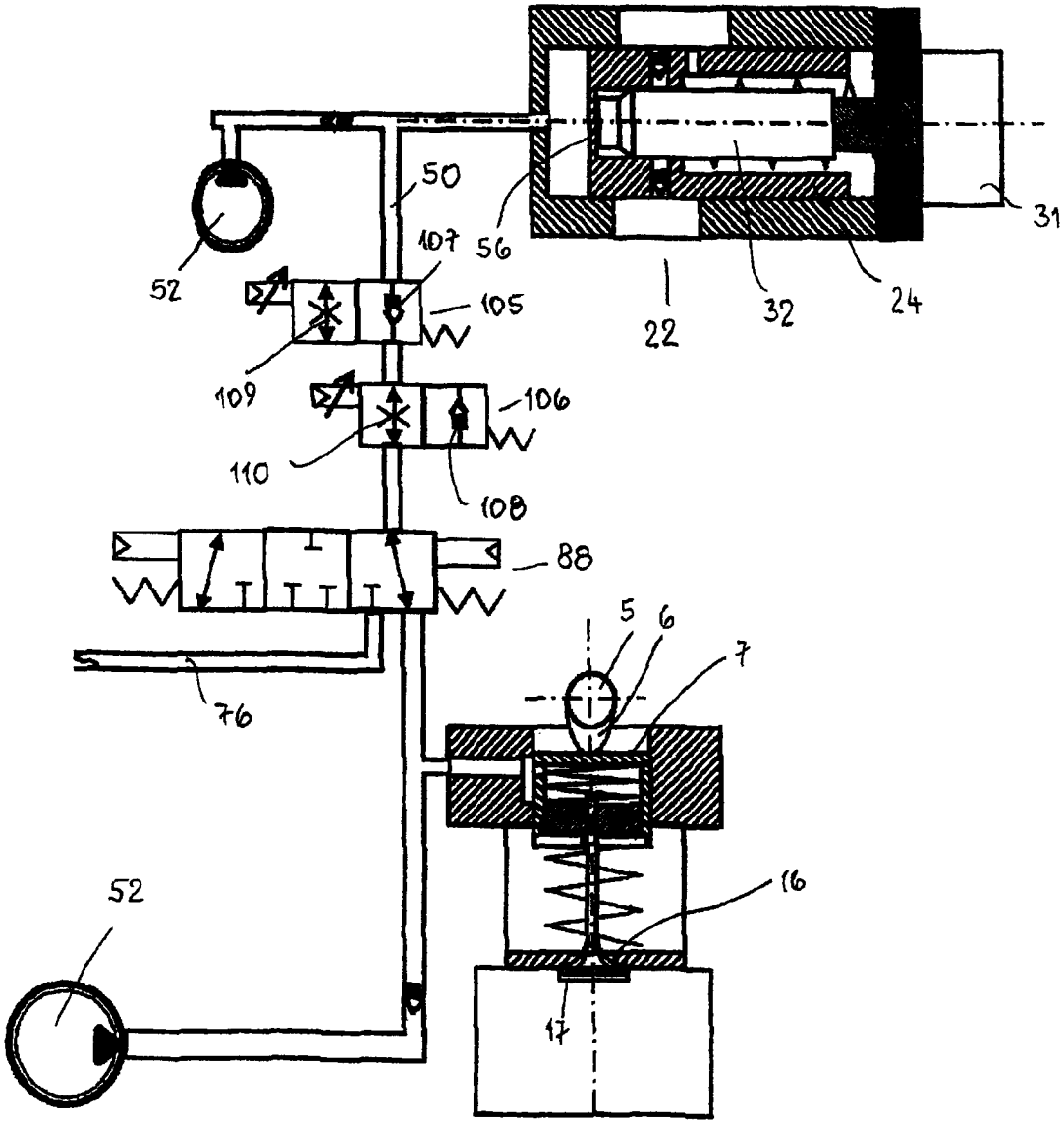

FIG. 10 shows an embodiment in which the valve stroke curve can be individually influenced with the help of throttle valves. The adjustment accumulator 22 is formed equal as in the embodiment according to FIG. 2. The storage piston 24 with its bottom 56 is attached to the adjustment element 32. The valve tappet 7 is shifted by the cam 6 of the camshaft 5 according to the set position of the adjusting element 32 maximum downwards, so that the valve plate 17 releases the inlet/outlet opening 16.

In the transverse line 50 there are two throttle valves 105, 106 in succession. The proportional valve 88 is downstream.

Both throttle valves 105, 106 each have a check valve 107, 108 and an orifice 109, 110. The check valve 107 of the throttle valve 105 opens in the direction of the adjustment accumulator 22 and the check valve 108 of the throttle valve 106 in the direction of the motor valve.

The throttle valve 105 is switched so that the check valve 107 opens in the flow path of the pressure medium to the adjustment accumulator 22. The other throttle valve 106 is switched so that its throttle aperture 110 is in the flow path. This means that throttling takes place in the opening direction of the motor valve.

The proportional valve 88 is according to the embodiment according to FIG. 8 trained and switched.

Due to the throttle valves 105, 106, the valve stroke curve can be individually influenced. Thus, the height of the valve stroke, the opening time of the valves, the opening or closing point of the valves as well as a combination of these sizes can be made. For example, the stroke shape can be varied. Usually, the valve stroke curves have a bell-like course, as exemplified by FIG. 2*b*. The valve stroke shape can be varied as an example, but also in such a way that it has almost rectangular shape or triangle shape. If the valve stroke curve has an example of rectangular shape, then fine control is difficult, because even at the smallest stroke a lot of gas or fuel-gas mixture flows into the engine. In this case, with the help of the throttle valves 105, 106, the shape of the valve stroke curve can be changed again in the direction of a bell shape or alike, in which the fine control is much simpler and more sensitive than with an approximate rectangular shape of the valve stroke curve.

When closing the motor valve, the two throttle valves 105, 106 can be switched, so that the throttling by means of the throttle panel 109 takes place in the closing direction of the motor valve.

Figure 11:
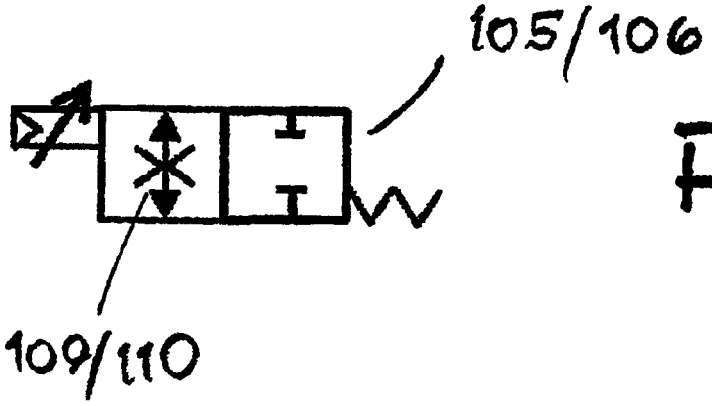

FIG. 11 shows a simpler formation of a throttle valve. It does not have a check valve, but only the throttle hood 109, 110. The throttle valve 105, 106 thus throttles the flow of the pressure medium in one position, while in the other position it blocks the flow.

Figure 12:
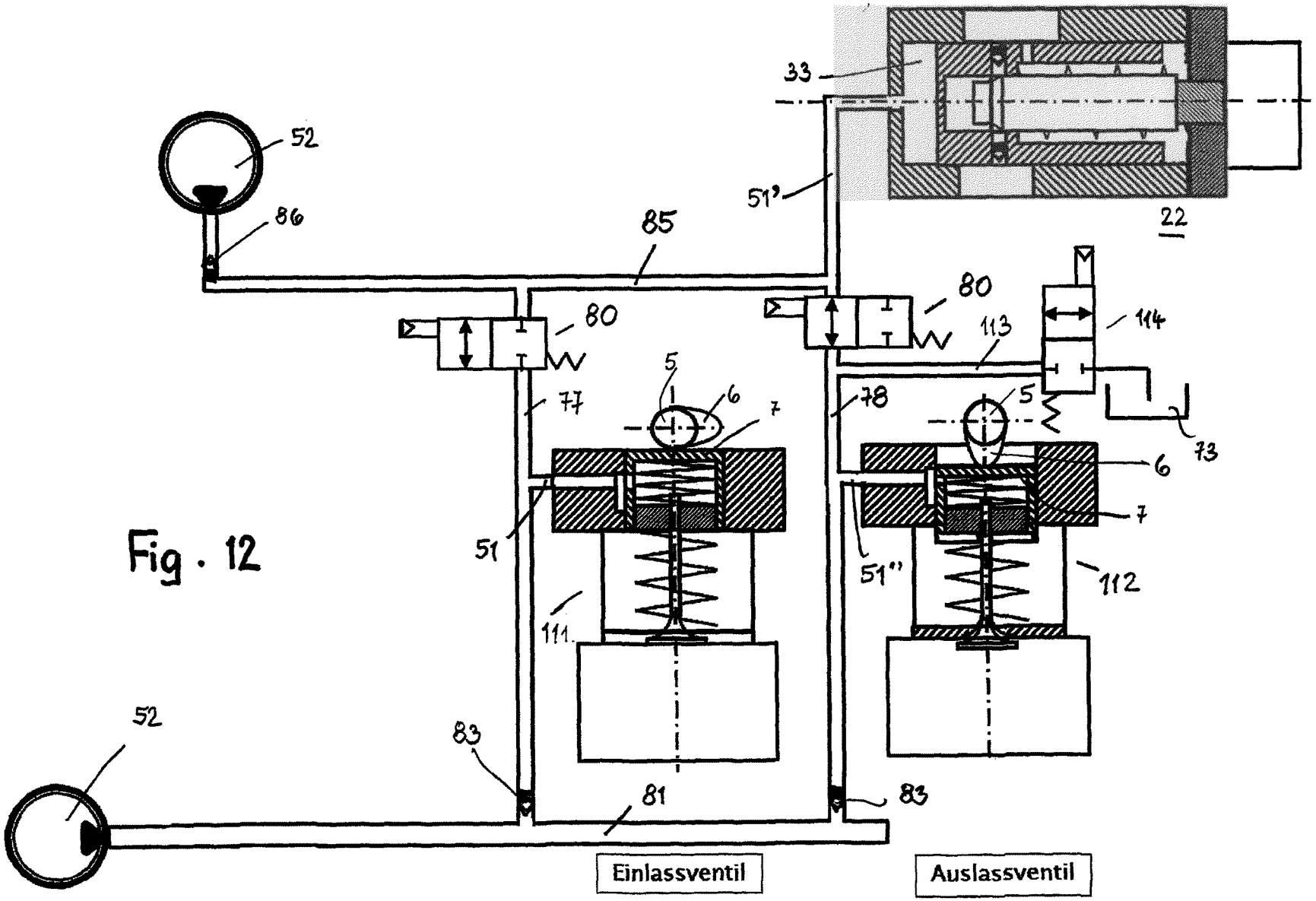

FIG. 12 shows an embodiment in which the inlet valve 111 and the outlet valve 112 are in series. Both valves are connected to the common adjustment accumulator 22. In the storage space 33 of the adjustment accumulator 22 flows the line 51', from which the collection line 85 branches off. From it, the transverse lines 77, 78 branch off. The transverse line 77 is connected via the line 51 with the inlet valve 112 and the transverse line 78 via the line 51" with the outlet valve 112. The transverse lines 77, 78 are secured against the collective line 81 by the check valve 83.

In the transverse line 77, the locking valve 80 sits in front of the inlet valve 111. Such a blocking valve 80 is also arranged in the transverse line 78 in front of the outlet valve 112. Between the shut-off valve 80 and the outlet valve 112 branches off from the transverse line 78 a tank line 113, which is connected to the tank 73 and in which a locking valve 114 sits.

In the illustration according to FIG. 12 the locking valve 80 assigned to the outlet valve 112 is opened, while the shut-off valve 80 is closed on the inlet valve side. The cam 6 of the camshaft 5 is located in the six o'clock position in which the valve tappet 7 of the outlet valve 112 has been moved in the manner described, so that the outlet valve 112 is opened.

The cam 6 of the camshaft 5 assigned to the inlet valve 111 is located in the three-hour position, so that the tappet 7 of the inlet valve 111 is not yet moved and accordingly the inlet valve is closed. The blocking valve 114 in the tank line 113 is closed, so that the pressure medium cannot be discharged to the tank 73.

In order to close the outlet valve 112, the shut-off valve 114 is opened, so that the pressure medium is returned to the tank 73 when pushing the tappet 7 back via the tank line 113.

In the event that the inlet valve 111 should already open before the outlet valve 112 is closed, the shut-off valve 80 for the outlet valve 112 can be closed earlier. This avoids a hydraulic cross-connection via the collection line 85 from the outlet valve 112 to the inlet valve 111.

When executed according to FIG. 12 a second valve opening of the outlet valve 112 can be initiated by a targeted overlap. A camshaft with an additional cam, as in the embodiment according to FIG. 2*a*, this is not required. Through the hydraulic connection, the pressure medium flows from the closing valve to the opening valve. This is easily achievable by different spring preloads. The combination of the inlet valve 111 with the outlet valve 112 results in the function of the double stroke for the outlet valve 112 to perform an internal exhaust gas recirculation.

The pump 52 allows a refilling of leakage losses in the adjustment accumulator 22. In the collection line 85 sits the check valve 86, which locks against the pump.

Figure 13:
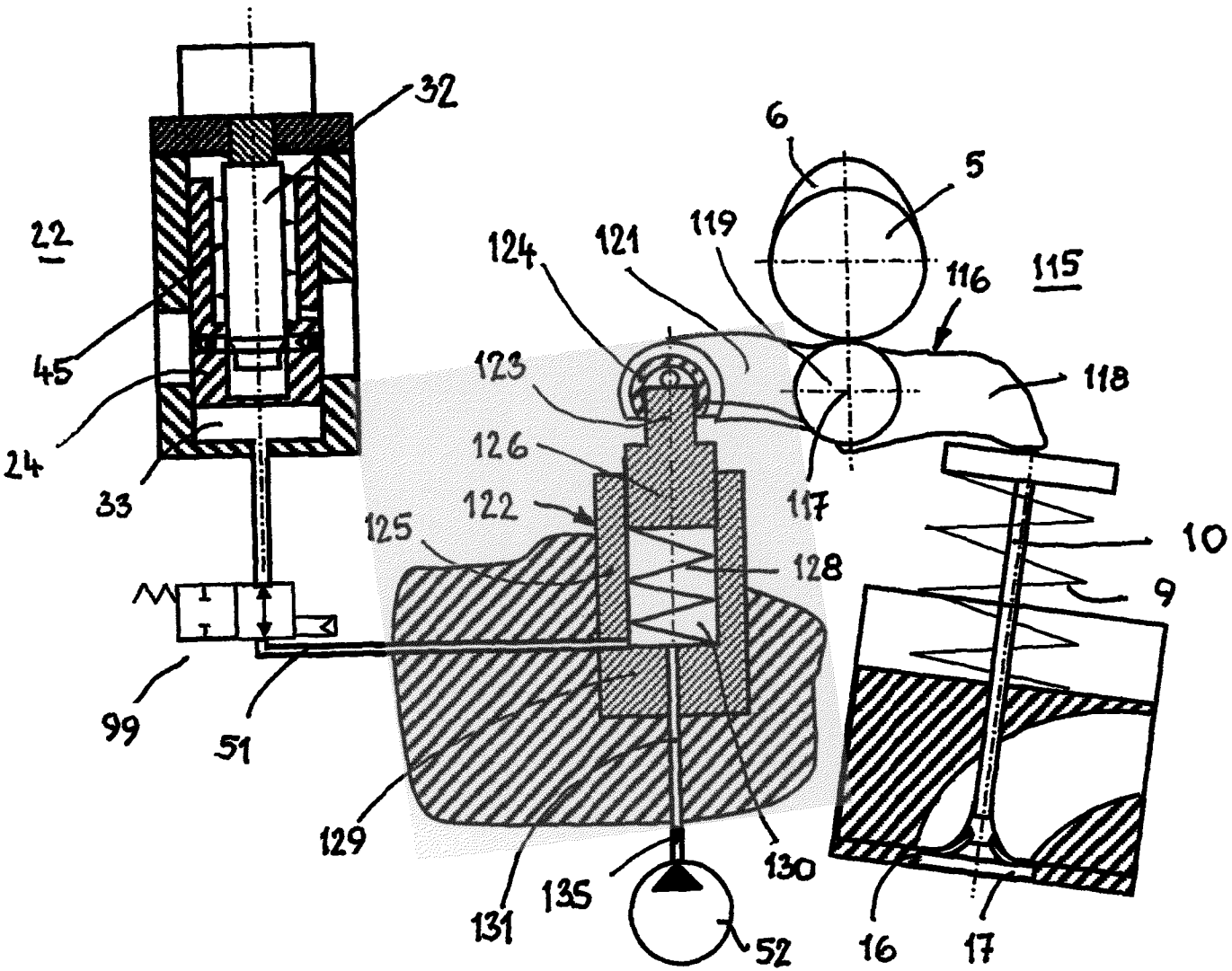

FIG. 13 shows the exemplary possibility to combine the adjustment accumulator 22 not only with a valve tappet, but with another control device 115 for the motor valve.

The control device 115 has a two-armed lever 116, which is mounted around an imaginary axis lying parallel to the camshaft axis.

On the lever 116, a roller 119 is mounted around an imaginary axis 117 lying parallel to the axis of the camshaft 5. The roll 119 is connected to the camshaft 5.

At the free end of one lever arm 121 is a play-equal element 122, which intervenes with a pestle 123 into a pan 124 at the free end of the lever arm 121. The pestle 123 with its free end lies on a semi-spherical inner surface of the pan 124. The play equalization element 122 has a housing 125, in which a piston 126 is movable. It is provided with the pusher 123 and loaded by at least one compression spring 128 in the direction of the lever arm 121. The compression spring 128 is supported by a bottom 129 of the housing 125.

Between the piston 126 and the housing bottom 129 there is a receiving room 130, into which the line 51 flows, which connects the play balancing element 122 with the adjustment accumulator 22.

In line 51, as shown, the switching valve 99 can sit. It can be used to influence the valve stroke curve. However, this switching valve 99 is only optional. Even without the switching valve 99, the device works according to FIG. 13.

A bore 131, which is connected to the pump 52 and in which a check valve 135 sits, flows into the bottom of the reception room 130.

At the free end of the other lever arm 118 of the lever 116, the free end of the valve shaft 10 is attached. If the lever 116 is clockwise in the display according to FIG. 13 swivel, the valve shaft 10 is shifted against the force of the compression spring 9, so that the valve plate 17 opens the inlet/outlet opening 16 of the combustion chamber. The lever 118 is guided through the storage-forming pan 124.

Instead of such a pan, an open bearing for example can be used for guiding.

The adjustment accumulator 22 is in the embodiment according to the embodiment according to FIG. 2 designed.

With the adjustment accumulator 22, the stroke of the valve can be varied in the described way. The pressure medium located in the receiving chamber 130 is displaced when pivoting the lever 116 first via the pipe 51 and the opened switching valve 99 into the storage chamber 33 of the adjustment accumulator 22 until the storage piston 24 at the adjusting element 32 a stop reach. As soon as the storage piston 24 is attached to the adjustment element 32, a further movement of the piston 126 by the lever 116 is no longer possible. Now the lever arm 121 supports the blocked piston 126, while the lever 116 is swiveled clockwise, whereby the valve shaft 10 is shifted and the inlet/outlet opening 16 opens. As soon as the cam 6 of the camshaft 5 is released from the roller 119 of the lever 116, the valve shaft 10 is pushed back by the compression spring 9 and thus the inlet/outlet opening 16 is closed. At the same time, the compression spring 128 in the play equalization element 122 pushes the piston 126 into its in FIG. 13 shown starting position. The pressure medium located in the storage space 33 of the adjustment accumulator 22 is displaced via the opened switching valve 99 and the line 51 back into the receiving chamber 130 of the play equalization element 122. This is done in that in the manner described the storage piston 24 is pushed back by the compression spring 45 to its initial position.

The compression spring 128 in the game equalization element 122 is designed so that first a relative shift between the housing 125 and the piston 126 takes place in order to displace the in the receiving room 130 pressure medium in the storage space 33 of the adjustment accumulator 22.

The different adjustment accumulators 22 can be combined in different types and functions with motor valves 1 to 4. Thus, for each inlet valve and each outlet valve, an adjustment accumulator 22 can be provided, so that each motor valve 1 to 4 can be individually actuated.

With two inlet or outlet valves, both valves or their hydraulic tappet can be switched to an adjustment storage 22.

Furthermore, it is possible, by way of example, to combine an adjustment accumulator 22 for the release valve of a motor cylinder I with an outlet valve of a cylinder II. Here, a sufficient time interval is given to combine the inlet valve with the outlet valve, if both valves perform comparable valve strokes. This switching logic is then applied in the same way for the further cylinders of the engine.

Another circuit may consist in combining an adjustment accumulator 22 for the outlet valve with the outlet valve of the next cylinder. Even then, there is sufficient time to use the adjustment accumulator one after the other for both outlet valves. In this way, the other cylinders of the engine can be connected to each with an adjustment accumulator 22, such as the second cylinder with the fourth cylinder.

On the inlet side, the inlet valves can also be connected in this way in pairs with an adjustment accumulator 22 each. Thus, for example, the inlet valve of cylinder I can be combined with the inlet valve of the next cylinder III, the inlet valve of cylinder II with the inlet valve of cylinder IV, etc.

Figure 14:
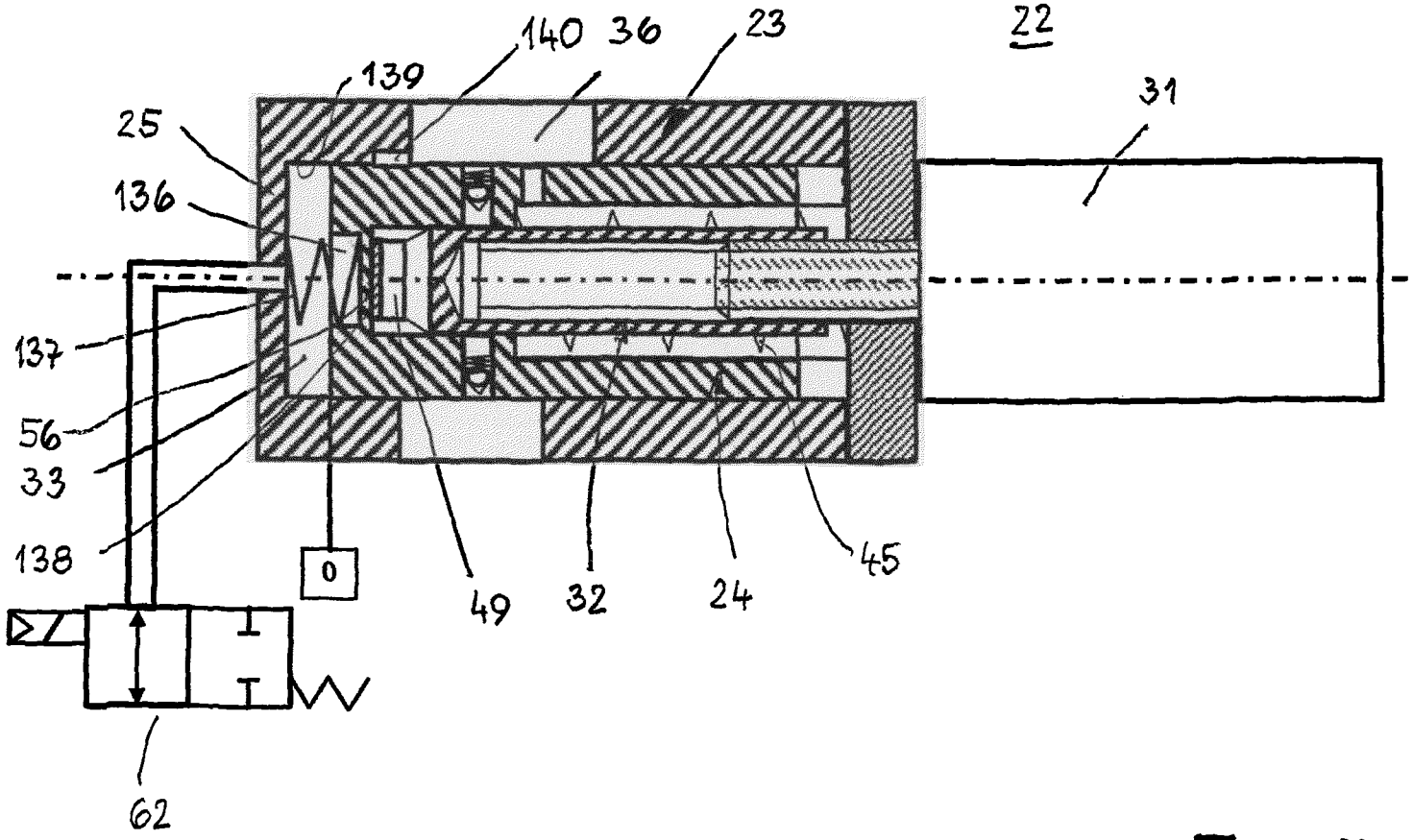

FIG. 14 shows an adjustment accumulator 22, which is essentially the same as the embodiment according to FIG. 3. Therefore, only the differences to this embodiment are described below.

The bottom 56 of the storage piston 24 is arranged recessed, so that in the end side of the storage piston 24 a recess 136 is formed. In it rises a compression spring 137, which supports itself with one end on the recessed bottom 56 and with the other end on the ceiling 25 of the housing 23.

On the facing from the ceiling 25 facing side of the floor 56 there is a thin disc-shaped sliding or bearing element 138, over which the end portion 49 of the adjustment element 32 is located on the ground 56.

In the inner wall 139 of the housing 29 there is a bypass opening 140, which flows into the breakout 36 of the housing 23 and extends from the breakthrough 36 in the direction to the lid of the housing 23. In normal operation of the adjustment accumulator 22, the bypass opening 140 is closed by the storage piston 24.

The storage piston 24 is in a 0 position, which is located in FIG. 14 is marked "0". The 0-line is related to the end face of the storage piston 24. In this 0 position, the force of the compression spring is 137 zero. This allows the storage room 33 to remain filled with oil. The compression spring 137 is significantly weaker than the compression spring 45 and positions the storage piston 24 in the shown 0 position.

The adjustment of the storage piston 244 in the direction of the lid 25 can be controlled stroke-variable or even only digitally from the zero position. A pressure sensor provided in the system or an electro-magnetic signal from the actuator can support the control accuracy.

With this embodiment, the valve can be actively controlled. By actuating the adjustment motor 31 or the switching valve 62, the adjustment accumulator 22 acts as a pump, with which the valve 1 to 4 can be additionally actuated. The pressure medium in the storage chamber 33 acts as a displacement piston, with which the valves 1 to 4 (FIG. 1) can be additionally loaded in the opening direction via the valve 62.

If the valves 1 to 4 are adjusted in the closing position, the pressure in the storage room 33 can be actively relieved by the adjustment element 32 is retracted. This makes a larger volume available in accumulator space 33 for displacing the print medium. The closing speed of the valves 1 to 4 can be increased in this way, so that the valves 1 to 4 are adjusted accelerated to the closing position.

The additional adjustment is possible, for example, if the cam 6 of the camshaft 5 shifts the corresponding tappet 7 against the force of the tappet push spring 13 (opening the valve) or if the cam 6 with the valve tappet 7 is not in intervention (closing the valve). With the adjustment accumulator 22 it is possible, for example, to open the outlet valve when the inlet valve is also open. This allows an internal engine exhaust gas recirculation (EGR).

In this embodiment, superimposed functions of the inlet and outlet valve sped over the geometric shape of the cam 6 of the camshaft 5 can be introduced.

Figure 15:
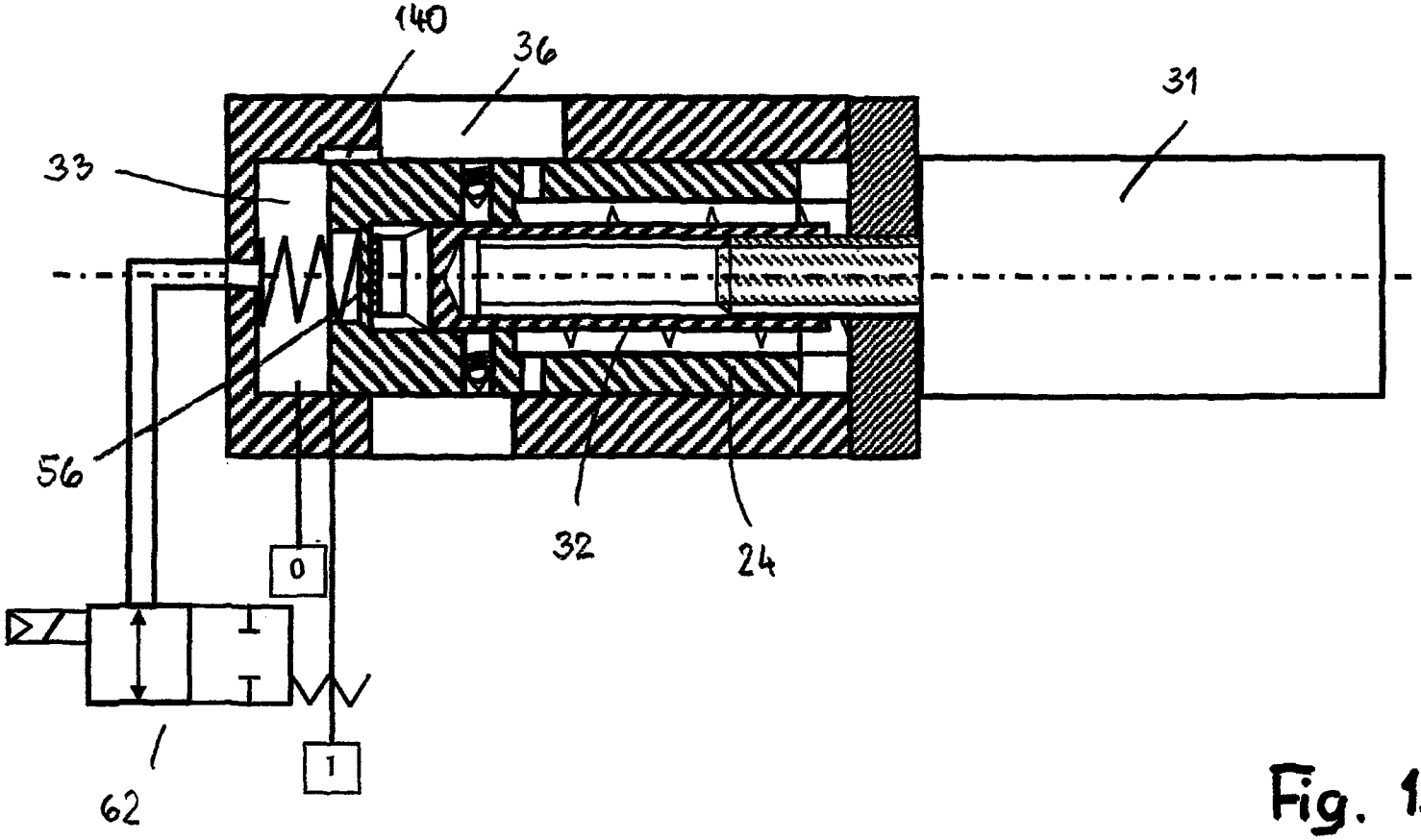

From FIG. 15, the function of the bypass opening 140 emerges. In order to actively close the door valve more quickly, the storage piston 24 can be accelerated by means of the adjusting motor 31 or by means of a switching valve to the stop position 1, in which the storage piston 24 with the recessed bottom 56 on the adjustment element 32 in the manner described. If this function of the adjustment accumulator 32 is to be performed more often, the accumulator space 33 could be over filled with time, since the adjustment element 32 is always reduced further. From a certain position of the adjustment element 32, the storage piston 24 can return so far that the bypass opening 140 is released. Then the medium located in the storage space 33 can be returned to the tank via the breakout 36.

In the event of a malfunction or too large amount of medium in the storage space 33, too high pressure or too large a medium quantity can be degraded via a pressure limiting valve located in the accumulator line.

The invention claimed is:

1. A device for adjusting a stroke of a valve of combustion motors comprising an actuating element for a valve shaft which operates by use of a camshaft, wherein the actuating element includes a reception chamber for a pressure medium, the reception chamber is connected with at least one storage space of at least one adjustable accumulator that has an adjustable volume adjustable by a storage piston, the storage piston is loaded in a direction of the storage space with a force (F1) greater than a force exerted by the pressure medium and smaller than a resetting force (F2) acting on the piston, wherein an adjustment distance of the storage piston is adjustable by at least one adjustment element, the adjustment element protrudes into the accumulator piston and is provided with a face-side stop surface for the storage piston.

2. The device according to claim 1, wherein the storage piston is a hollow piston of the adjustment accumulator and is under a force of at least one reset spring.

3. The device according to claim 1, a damping chamber, which is at least partially filled with the pressure medium, is between the adjustment element and the storage piston.

4. The device according to claim 1, wherein the storage piston is provided with at least one supply line for leakage medium, in which a damping chamber opening check valve sits.

5. The device according to claim 1, wherein the receiving chamber is connected to a pump via a line and in the line sits a valve closing against the pump.

6. The device according to claim 5, further comprising a plurality of valves connected to the adjustment accumulator and a locking valve sits in each connection from the adjustment accumulator to the plurality of valves.

7. The device according to claim 6, wherein, for a fail-save function, the accumulator piston is mechanically or hydraulically retractable to an output position in which the volume of the storage space is reduced so that each of the plurality of valves performs its maximum stroke.

8. The device according to claim 6, wherein the camshaft includes a first cam and a second cam, the second cam having a second smaller opening stroke than the first cam, and in a supply line, from the adjustment accumulator to each of the plurality of valves, is a switching valve which is closed by the second cam when actuating the actuating element, and in the supply line, from the adjustment storage to the actuating element, sits at least one throttle valve.

9. The device according to claim 1, wherein the storage piston is controlled to increase pressure of the pressure medium.

10. The device according to claim 1, wherein the adjustment element is retracted during closing of the valve to increase the storage space controlled.

11. The device according to claim 1, further comprising an inlet valve and an outlet valve connected to a common adjustment accumulator.

12. The device according to claim 11, wherein the inlet valve and the outlet valve are connected to the adjustment accumulator via a common supply line and from the common supply line is one branch line, in which includes a switching valve, which goes to the inlet valve and to the outlet valve.

13. The device according to claim 1, wherein the actuating element is a valve tappet or a two-armed lever, which acts together with the camshaft, and wherein the two-armed lever includes a first lever arm interacting with a valve shaft and a second lever arm interacting with a piston of a clearance equalization element.

14. The device according to claim 13, wherein the piston limits a recording space which is connected to the storage space of the adjustment accumulator, and the storage space is connected via at least one bypass opening to a tank, which can be closed by the storage piston.

15. The device according to claim 1, wherein the at least one adjustment element is a motor or hydraulic element.

16. The device according to claim 5, wherein the valve closing against the pump is a check valve.

17. A device for adjusting a stroke of a valve of combustion motors comprising:

a tappet movable in a bore of a cylinder head;

a liner of the valve tappet with an opening and which further defines reception room;

a piston moveable within the valve tappet;

at least one spring surrounding a valve shaft fastened with one end to the piston;

at least one tappet push spring which supports itself at one end on the piston and at another end on a bottom of the valve tappet;

a feeding room in the cylinder head in fluid communication between the reception room through the opening of the liner;

a hole in the cylinder head which connects the reception room to an adjustment accumulator;

a hollow piston storage piston is slidable within a housing of the adjustment accumulator and which is closed on one end side by a ceiling, in which there is a passage opening and at an opposite end side, the housing is closed by a cover disc;

a sleeve-shaped adjustment element protruding over a length in the hollow portion of the hollow piston storage piston; and a storage space between the hollow piston storage piston and a ceiling of the housing, whose volume changes depending on a relative position of the hollow piston storage piston compared to the housing as adjusted by the sleeve-shaped adjustment element.

18. The device according to claim 17, wherein the sleeve-shaped adjustment element is rotationally connected to the storage piston.

19. The device according to claim 18, further comprising a driven threaded spindle driven rotatably around its axis and which is rotatable mounted on the cover plate, and the sleeve-shaped adjustment element sits on the threaded spindle.

* * * * *